US008867956B2

(12) United States Patent
Sato

(10) Patent No.: US 8,867,956 B2
(45) Date of Patent: Oct. 21, 2014

(54) IMAGE FORMING DEVICE

(75) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 113 days.

(21) Appl. No.: 13/362,001

(22) Filed: Jan. 31, 2012

(65) Prior Publication Data

US 2012/0207511 A1 Aug. 16, 2012

(30) Foreign Application Priority Data

Feb. 10, 2011 (JP) ..... 2011-027518

(51) Int. Cl.
*G03G 21/16* (2006.01)
*G03G 21/18* (2006.01)

(52) U.S. Cl.
CPC ..... *G03G 21/1853* (2013.01); *G03G 21/16* (2013.01); *G03G 21/1642* (2013.01); *G03G 21/1695* (2013.01); *G03G 21/1666* (2013.01); *G03G 2221/1684* (2013.01); *G03G 2221/1869* (2013.01); *G03G 2221/1654* (2013.01); *G03G 21/1633* (2013.01)
USPC ..... 399/110

(58) Field of Classification Search
CPC ..... G03G 21/16
USPC ..... 399/110, 113–114, 159
See application file for complete search history.

(56) References Cited

U.S. PATENT DOCUMENTS 6,075,958 A 6/2000 Gotoh et al.
7,447,467 B2 11/2008 Kamimura et al.
8,000,628 B2 8/2011 Sato et al.
8,005,397 B2 8/2011 Sato
8,150,294 B2 4/2012 Okabe et al.
8,185,016 B2 5/2012 Mori et al.
8,320,797 B2 11/2012 Inomata et al.
2006/0140673 A1 6/2006 Kamimura et al.
2009/0169245 A1 7/2009 Sato
2009/0226205 A1 9/2009 Sato et al.
2009/0269101 A1 10/2009 Okabe et al.
2010/0074649 A1* 3/2010 Kondo ..... 399/113
2010/0166455 A1 7/2010 Mori et al.
(Continued)

FOREIGN PATENT DOCUMENTS

JP 04-212973 A 8/1992
JP 04-371422 A 12/1992
(Continued)

*Primary Examiner* — Clayton E Laballe
*Assistant Examiner* — Kevin Butler
(74) *Attorney, Agent, or Firm* — Banner & Witcoff, Ltd.

(57) ABSTRACT

A first retaining member is configured to be moved in a prescribed direction between a mounted position and a pulled-out position. A plurality of exposure units is configured to move between a first adjacent position in which each of the plurality of exposure units is located adjacent to the corresponding photosensitive drum to expose thereof and a first retracted position in which each of the plurality of exposure unit is moved away from the corresponding photosensitive drum in a direction intersecting with the prescribed direction. A space is formed by removing a tray from a main casing. Each of the plurality of exposure units is moved to the space to be moved to the first retracted position such that each of the plurality of exposure units fails to interfere with the first retaining member in the prescribed direction when the first retaining member moves from the mounted position to the pulled-out position.

17 Claims, 13 Drawing Sheets

1

(56) References Cited

U.S. PATENT DOCUMENTS

| | | | |
|---|---|---|---|
| 2010/0322666 | A1 | 12/2010 | Inomata et al. |
| 2011/0255902 | A1 | 10/2011 | Sato et al. |
| 2012/0027472 | A1 | 2/2012 | Kamimura et al. |
| 2012/0189346 | A1 | 7/2012 | Okabe et al. |
| 2012/0195625 | A1 | 8/2012 | Sato et al. |
| 2012/0308273 | A1 | 12/2012 | Kamimura et al. |

FOREIGN PATENT DOCUMENTS

| | | | |
|---|---|---|---|
| JP | 11-160948 | A | 6/1999 |
| JP | 2002-174999 | A | 6/2002 |
| JP | 2002-268320 | A | 9/2002 |
| JP | 2005-099415 | A | 4/2005 |
| JP | 2006-058913 | A | 3/2006 |
| JP | 2006-184552 | A | 7/2006 |
| JP | 2007-298655 | A | 11/2007 |
| JP | 2008-296379 | | 12/2008 |
| JP | 2009-009119 | A | 1/2009 |
| JP | 2009-210937 | A | 9/2009 |
| JP | 2009-265442 | | 11/2009 |
| JP | 3160963 | | 6/2010 |
| JP | 2010-276905 | A | 12/2010 |
| JP | 2011-007828 | A | 1/2011 |

* cited by examiner

IMAGE FORMING DEVICE

CROSS REFERENCE TO RELATED APPLICATION

This application claims priority from Japanese Patent Application No. 2011-027518 filed Feb. 10, 2011. The entire content of the priority application is incorporated herein by reference.

TECHNICAL FIELD

The present invention relates to an image forming device using an electrophotographic method.

BACKGROUND

As a color printer using an electrophotographic method, an LED exposure type color printer has been conventionally well known in the art. One such LED exposure type color printer includes four photosensitive drums for colors of yellow, magenta, cyan, and black, and four LED exposure units for exposing the corresponding photosensitive drums.

In the LED exposure type color printer, it is required to dispose the LED units adjacent to the corresponding photosensitive drums in order for the photosensitive drums to be exposed by the respective LED units.

Because the LED units are disposed adjacent to the photosensitive drums, the LED units need to be moved away from the photosensitive drums when the photosensitive drums are replaced. For this reason, a mechanism for bringing the LED units close to the corresponding photosensitive drums and moving the LED units away from the corresponding photosensitive drums is required.

A proposal has been made that one such color printer provided with the above-described mechanism includes a main casing having a top cover, a plurality of process units each including a photosensitive drum, and a plurality of LED units for exposing the photosensitive drums. The LED units are connected to the top cover formed on the top of the main casing. In response to open and closure movements of the top cover, the LED units are moved between an exposure position in which the LED units expose the corresponding photosensitive drums and a retracted position in which the LED units are moved upward away from the corresponding photosensitive drums.

Further, another printer including a main casing on which a flatbed scanner is provided, a drum unit having a plurality of photosensitive drums, and a plurality of LED units for exposing the photosensitive drums has been proposed. In this printer, in response to open and closure movements of a front cover provided at a front wall of the main casing, the LED units approach the corresponding photosensitive drums and are moved upward away from the corresponding photosensitive drums.

SUMMARY

With regard to the former color printer, each LED unit is moved in response to open and closure movements of the top cover.

This structure requires a large space for opening and closing the top cover above the main casing. Accordingly, it may be difficult to reduce a space for placing the color printer.

With regard to the latter printer, the flatbed scanner is disposed above the main casing. Each LED unit is moved in response to open and closure movements of the front cover provided at the front wall of the main casing.

Each LED unit is moved upward away from the corresponding photosensitive drum in this case.

This also requires a space into which the LED units are retracted at an upper portion of the main casing. Hence, downsizing of the main casing may be difficult. Further, it may also be difficult to reduce a space in which the printer is placed.

In view of the foregoing, it is an object of the present invention to provide a compact image forming device having a downsized main casing and capable of reducing a space for placing the image forming device.

In order to attain the above and other objects, the present invention provides an image forming device including a main casing, a first retaining member, an endless belt, a plurality of exposure units, and a supply tray. The first retaining member retains a plurality of photosensitive drums juxtaposedly arrayed and spaced away from each other in a prescribed direction. The first retaining member is configured to move in the prescribed direction between a mounted position in which the first retaining member is mounted in the main casing and a pulled-out position in which the retaining unit is pulled out of the main casing. The endless belt is disposed above the first retaining member to oppose the plurality of photosensitive drums. The plurality of exposure units is disposed below the endless belt and is configured to move between a first adjacent position in which each of the plurality of exposure units is located adjacent to the corresponding photosensitive drum to expose thereof and a first retracted position in which each of the plurality of exposure unit is moved away from the corresponding photosensitive drum in a direction intersecting with the prescribed direction. The tray is disposed in confrontation with the first retaining member from below and configured to be inserted into or removed from the main casing. A space is formed by removing the tray from the main casing. The tray is configured to supply a transferred medium on which developer image is transferred. Each of the plurality of exposure units is moved to the space to be moved to the first retracted position such that each of the plurality of exposure units fails to interfere with the first retaining member in the prescribed direction when the first retaining member moves from the mounted position to the pulled-out position.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
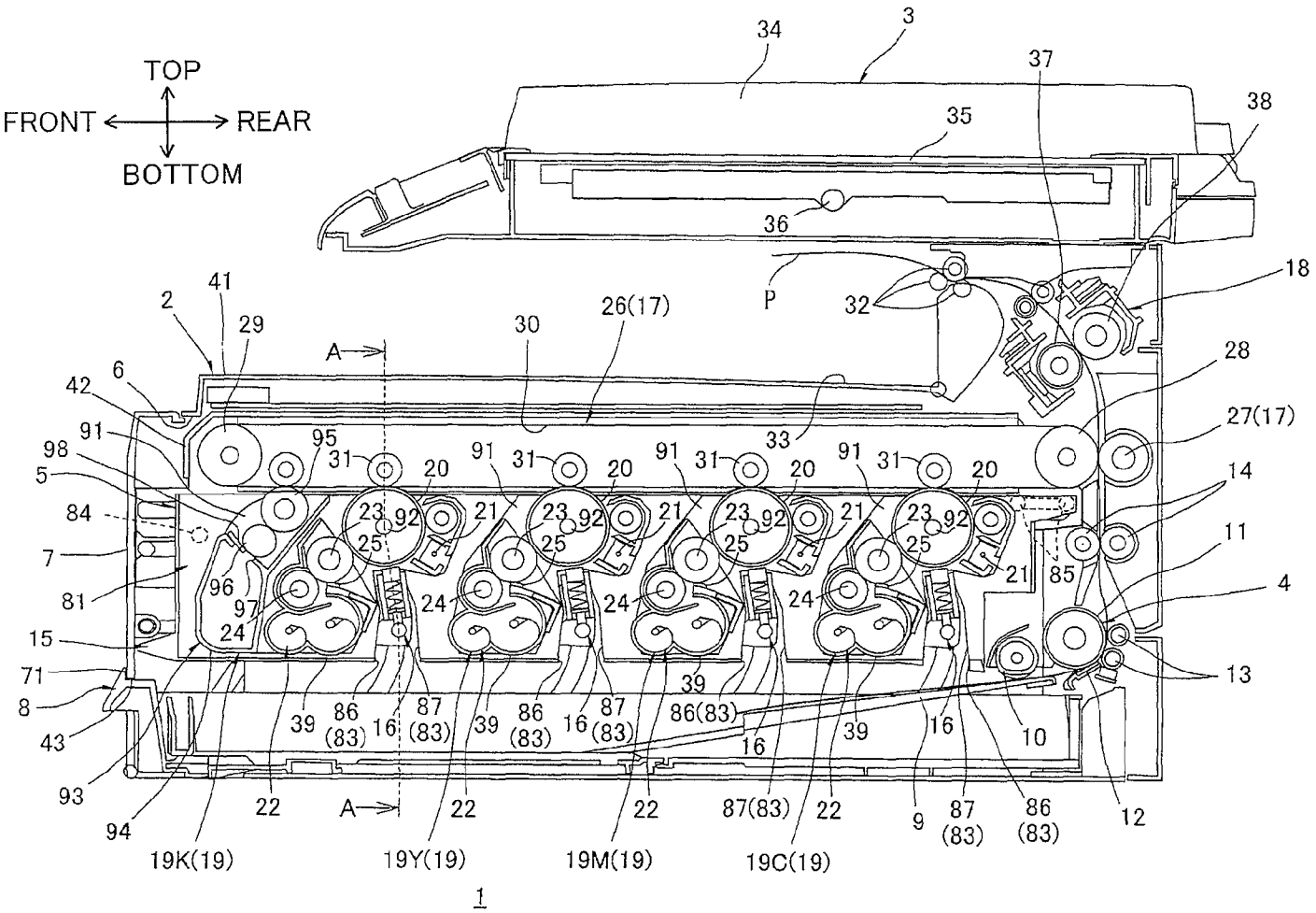
FIG. 1 is a cross-sectional view of a color printer as an image forming device according to a first embodiment of the present invention.

An image forming device according to a first embodiment of the present invention will be described while referring to FIGS. 1 to 7 wherein like parts and components are designated by the same reference numerals to avoid duplicating description.

1. Overall Structure of Color Printer

As shown in FIG. 1, the image forming device according to the first embodiment is a horizontal intermediate transfer type color printer 1.

The color printer 1 is a multifunctional device that is integrally provided with a main casing 2 and a flatbed scanner 3 for reading image data from original documents. The flatbed scanner 3 is disposed above the main casing 2.

Within the main casing 2, the color printer 1 is further provided with a sheet supply unit 4 and an image forming unit 5. The sheet supply unit 4 functions to supply a sheet of paper P to the image forming unit 5. The image forming unit 5 functions to form images on the sheet of paper P supplied from the sheet supply unit 4.

(1) Main Casing

The main casing 2 has a box shape that is substantially rectangular in a side view. The sheet supply unit 4 and the image forming unit 5 are mounted in the main casing 2. The main casing 2 has one side wall in which an opening 6 is formed. A front cover 7 is provided on the side wall so as to be pivotally movable about a lower end thereof between a closed position for closing the opening 6 and an open position for opening the opening 6.

The terms "upward", "downward", "upper", "lower", "above", "below", "beneath", "right", "left", "front", "rear" and the like will be used throughout the description assuming that the color printer 1 is disposed in an orientation in which it is intended to be used. In the following description, the side of the color printer 1 on which the front cover 7 is provided (left side in FIG. 1) will be referred to as the front side of the color printer 1, and a side opposite to the side (right side in FIG. 1) will be referred to as the rear side of the color printer 1. The top, bottom, left, and right sides of the color printer 1 in the following description will be based on the reference point of a user viewing the color printer 1 from the front side.

(2) Sheet Supply Unit

The sheet supply unit 4 includes a sheet supply tray 8 for accommodating sheets of paper P.

The sheet supply tray 8 is disposed at a bottom portion of the main casing 2. The sheet supply tray 8 is detachably mounted in the main casing 2. Further, the sheet supply tray 8 includes a lift member 9 for lifting a rear edge of the sheet P up and down.

The lift member 9 is formed in a generally rectangular plate shape extending in a frontward/rearward direction. The lift member 9 is disposed at a posterior half of a bottom surface of the sheet supply tray 8 and pivotally movable about a front edge thereof. Further, a rear edge of the lift member 9 is urged upward by an urging member (not shown) such as a coil spring.

The lift member 9 is in a slanted posture such that the lift member 9 slants upward toward the rear edge from the front edge by an urging force of the urging member (not shown) when the sheet supply tray 8 is mounted in the main casing 2 (FIG. 1). When the lift member 9 is in the slanted posture, the rear edge of the sheet P is lifted upward toward a pickup roller 10 (described later) to be pinched between the lift member 9 and the pickup roller 10.

Figure 5:
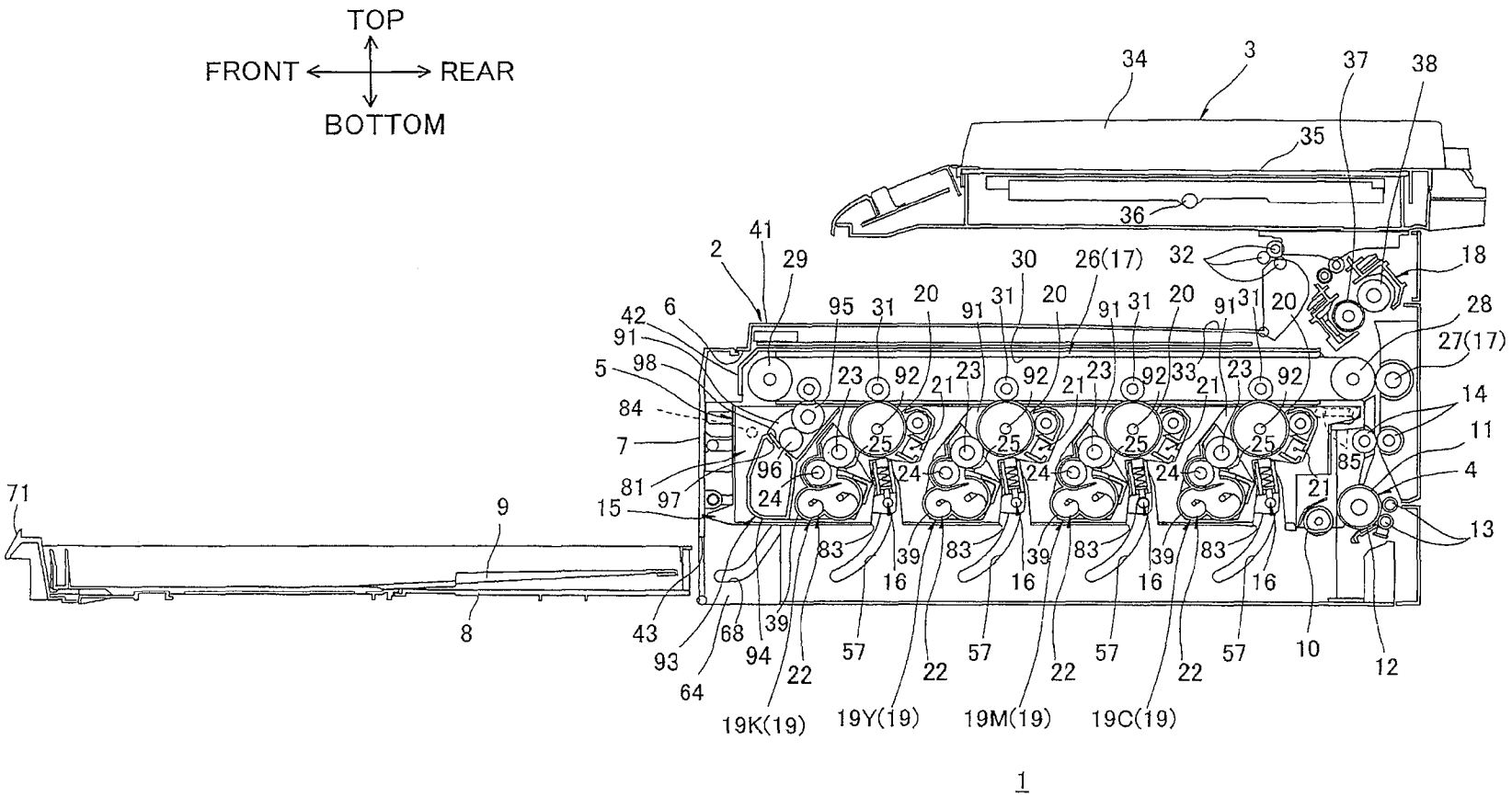
FIG. 5 is an explanatory view illustrating removal and mounting of a process cartridge relative to a main casing provided in the color printer shown in FIG. 1, in which a sheet supply tray has been removed from the main casing.

When the sheet supply tray 8 is removed from the main casing 2, the lift member 9 is gone down so as to lie down on the bottom surface of the sheet supply tray 8 against the urging force of the urging member (not shown) (FIG. 5). When the lift member 9 is gone down, the rear edge of the sheet P is accommodated within the sheet supply tray 8.

The sheet supply unit 4 includes the pickup roller 10, a sheet supply roller 11, a sheet supply pad 12, a pair of pinch rollers 13, and a pair of registration rollers 14. The pickup roller 10 is disposed above a rear end portion of the sheet supply tray 8, and opposite and above the rear edge of the lift member 9. The sheet supply roller 11 is disposed rearward of the pickup roller 10. The sheet supply pad 12 is disposed below and opposite the sheet supply roller 11. The pair of pinch rollers 13 opposes each other in a vertical direction. The pair of pinch rollers 13 is disposed rearward of the sheet supply roller 11 and contact the sheet supply roller 11. The pair of registration rollers 14 opposes each other in the frontward/rearward direction and disposed above the sheet supply roller 11.

The sheets P (indicated by a solid line shown in FIG. 1) accommodated in the sheet supply tray 8 are conveyed between the sheet supply roller 11 and the sheet supply pad 12 in conjunction with rotation of the pickup roller 10, and are separated sheet by sheet in conjunction with rotation of the sheet supply roller 11. Then, in conjunction with rotation of the sheet supply roller 11, the separated sheet P is conveyed toward the registration rollers 14 while passing between the sheet supply roller 11 and each pinch roller 13. In conjunction with rotation of the registration rollers 14, the sheet P is conveyed to the image forming unit 5 (between an intermediate transfer belt 30 (described later) and a secondary transfer roller 27 (described later)) at a prescribed timing.

(3) Image Forming Unit

The image forming unit 5 is disposed above the sheet supply unit 4. The image forming unit 5 includes a process unit 15, four LED units 16 corresponding to each color, a transfer unit 17, and a fixing unit 18.

(3-1) Process Unit

The process unit 15 is disposed above and opposite the sheet supply tray 8 and also disposed frontward of the sheet supply roller 11 so as to be overlapped with the pickup roller 10 when projected in the frontward/rearward direction. In other words, the process unit 15 is arranged to overlap with the pickup roller 10 in the frontward/rearward direction. The process unit 15 retains four process cartridges 19 corresponding to four colors (cyan, magenta, yellow, and black). Further, the process unit 15 is slidably movable in the frontward/rearward direction between a mounted position in which the process unit 15 is mounted in the main casing 2 and a pulled-out position in which the process unit 15 is pulled out of the main casing 2.

Four process cartridges 19 are juxtaposedly arrayed with each other at regular intervals in the frontward/rearward direction. More specifically, a black process cartridge 19K, a yellow process cartridge 19Y, a magenta process cartridge 19M, and a cyan process cartridge 19C are aligned in this order from front to rear.

Further, each process cartridge 19 includes a photosensitive drum 20, a Scorotron charger 21, and a developing unit 22.

The photosensitive drum 20 is cylindrical in shape extending in a rightward/leftward direction (longitudinal direction) and oriented with its axis along the rightward/leftward direction.

The Scorotron charger 21 is disposed diagonally below and rearward of the corresponding photosensitive drum 20, and confronts but does not contact the corresponding photosensitive drum 20.

The developing unit 22 is disposed diagonally below and frontward of the corresponding photosensitive drum 20. The four developing units 22 are juxtaposedly arrayed with each other at regular intervals in the frontward/rearward direction. The developing unit 22 includes a developing roller 23.

The developing roller 23 is rotatably supported in an upper end of the corresponding developing unit 22. An upper rear edge of the developing roller 23 is exposed through an upper edge of the developing unit 22 and contacts the corresponding photosensitive drum 20 from below.

The developing unit 22 also includes a supply roller 24 for supplying toner to the corresponding developing roller 23 and a thickness-regulating blade 25 for regulating the thickness of the toner supplied to the developing roller 23. Further, the developing unit 22 includes a toner accommodating section 39 for accommodating toner for a corresponding color therein. The toner accommodating section 39 is disposed below the supply roller 24. The toner accommodating section 39 is formed in a configuration such that two cylindrical bodies extending in the rightward/leftward direction are connected to each other in the frontward/rearward direction.

(3-2) LED Unit

Each LED unit 16 is disposed rearward of the corresponding developing unit 22. Further, the LED unit 16 is disposed below and confronts the corresponding photosensitive drum 20. The LED unit 16 exposes a surface of the corresponding photosensitive drum 20 based on prescribed image data.

(3-3) Transfer Unit

The transfer unit 17 includes a belt unit 26 and the secondary transfer roller 27.

The belt unit 26 is disposed above the process unit 15 so as to oppose each photosensitive drum 20 from above and oriented in the frontward/rearward direction.

The belt unit 26 includes a drive roller 28, a driven roller 29, the intermediate transfer belt 30, and four primary transfer rollers 31.

The drive roller 28 and the driven roller 29 are arranged in confrontation with and spaced apart from each other in the frontward/rearward direction.

The intermediate transfer belt 30 is formed of an endless belt. The intermediate transfer belt 30 is stretched around the drive roller 28 and the driven roller 29, with a lower portion of the intermediate transfer belt 30 contacting each of the photosensitive drums 20. The intermediate transfer belt 30 circulates so that the lower portion of the intermediate transfer belt 30 in contact with the photosensitive drums 20 moves rearward.

Each primary transfer roller 31 is disposed in confrontation with the corresponding photosensitive drum 20, interposing the lower portion of the intermediate transfer belt 30 between the primary transfer roller 31 and the photosensitive drum 20.

The secondary transfer roller 27 is disposed rearward of the belt unit 26. Further, the secondary transfer roller 27 is disposed in confrontation with the drive roller 28 of the belt unit 26, interposing the intermediate transfer belt 30 between the secondary transfer roller 27 and the drive roller 28.

(3-4) Fixing Unit

The fixing unit 18 is disposed above the secondary transfer roller 27. The fixing unit 18 includes a heating roller 37 and a pressure roller 38 disposed in confrontation with the heating roller 37.

(3-5) Image Forming Operations (3-5-1) Developing Operation

The toner accommodated in the toner accommodating section 39 of the developing unit 22 is supplied to the supply roller 24, and then to the developing roller 23.

As the developing roller 23 rotates, the thickness-regulating blade 25 regulates the toner carried on the surface of the developing roller 23 to a prescribed thickness, so that the developing roller 23 carries a uniform thin layer of toner thereon. The toner supplied to the developing roller 23 is positively tribocharged between the thickness-regulating blade 25 and the developing roller 23.

In the meantime, the Scorotron charger 21 applies uniform charge of positive polarity to a surface of the corresponding photosensitive drum 20 as the photosensitive drum 20 rotates. Subsequently, the LED unit 16 exposes the surface of the corresponding photosensitive drum 20 based on image data. An electrostatic latent image corresponding to an image to be formed on the sheet P is formed on the surface of the photosensitive drum 20.

As the photosensitive drum 20 continues to rotate, the positively charged toner carried on the surface of the developing roller 23 is supplied to the electrostatic latent image formed on the surface of the photosensitive drum 20, thereby developing the electrostatic latent image into a visible toner image through reverse development. Thus, the toner image is formed on the surface of the photosensitive drum 20.

(3-5-2) Transfer and Fixing Operations

The toner image formed on the surface of each photosensitive drum 20 through reverse development is primary-transferred onto the lower portion of the intermediate transfer belt 30 conveyed rearward from front, thereby forming a color image on the intermediate transfer belt 30.

The color image formed on the intermediate transfer belt 30 is secondary-transferred onto the sheet P supplied from the sheet supply unit 4 while the intermediate transfer belt 30 passes through a position N where the intermediate transfer belt 30 confronts the secondary transfer roller 27.

The color image transferred onto the sheet P is thermally fixed to the sheet P by heat and pressure in the fixing unit 18, as the sheet P passes between the heating roller 37 and the pressure roller 38.

(4) Discharge

After the color image has been fixed to the sheet P in the fixing unit 18, the sheet P is discharged by discharge rollers 32 onto a discharge tray 33 formed on a top surface of the main casing 2.

(5) Flatbed Scanner

The flatbed scanner 3 is disposed above the discharge tray 33. The flatbed scanner 3 includes a restraining cover 34, a glass plate 35, and a CCD sensor 36. After an original document is placed between the restraining cover 34 and the glass plate 35, the CCD sensor 36 is slidingly moved to read image data from the original document.

Based on the image data read from the original document, an image is formed on the sheet P in the image forming unit 5 as described above.

2. Main Casing

Figure 2:
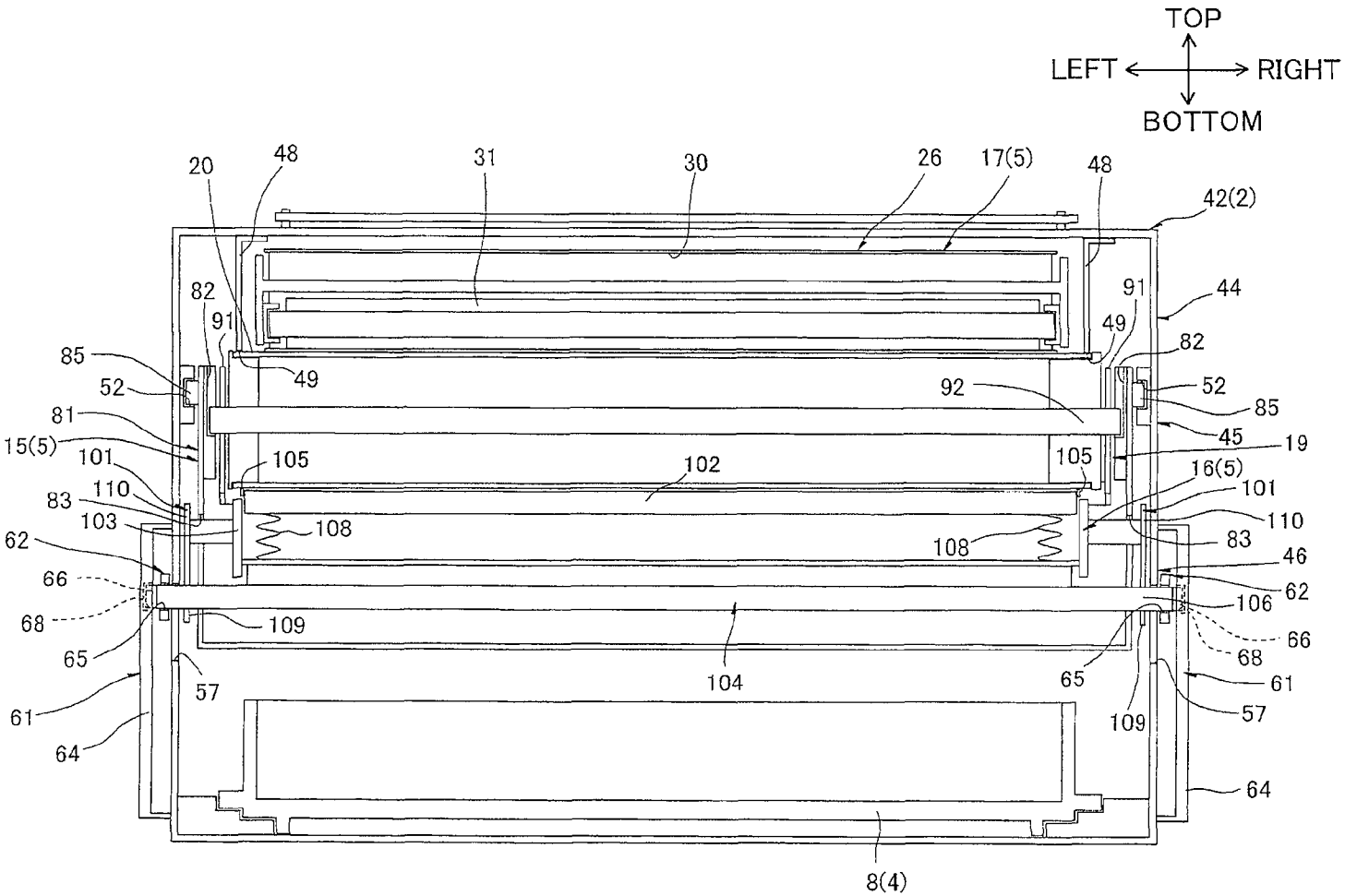
FIG. 2 is a cross-sectional view of the color printer shown in FIG. 1 along the line A-A in FIG. 1.

The main casing 2 includes an outer casing 41 and an inner casing 42 (FIG. 2). The outer casing 41 defines an outer shell of the color printer 1. The inner casing 42 is provided inside the outer casing 41.

(1) Details of Outer Casing

The outer casing 41 is formed in a generally box-shape. The outer casing 41 has a front wall on which the front cover 7 is provided.

The front cover 7 has a lower end that is pivotally movably connected to a bottom wall of the outer casing 41. An opening 43 is formed in a lower portion of the front cover 7. When the front cover 7 is in the closed position, the sheet supply tray 8 is inserted into or removed from the main casing 2 through the opening 43.

(2) Details of Inner Casing

Figure 3:
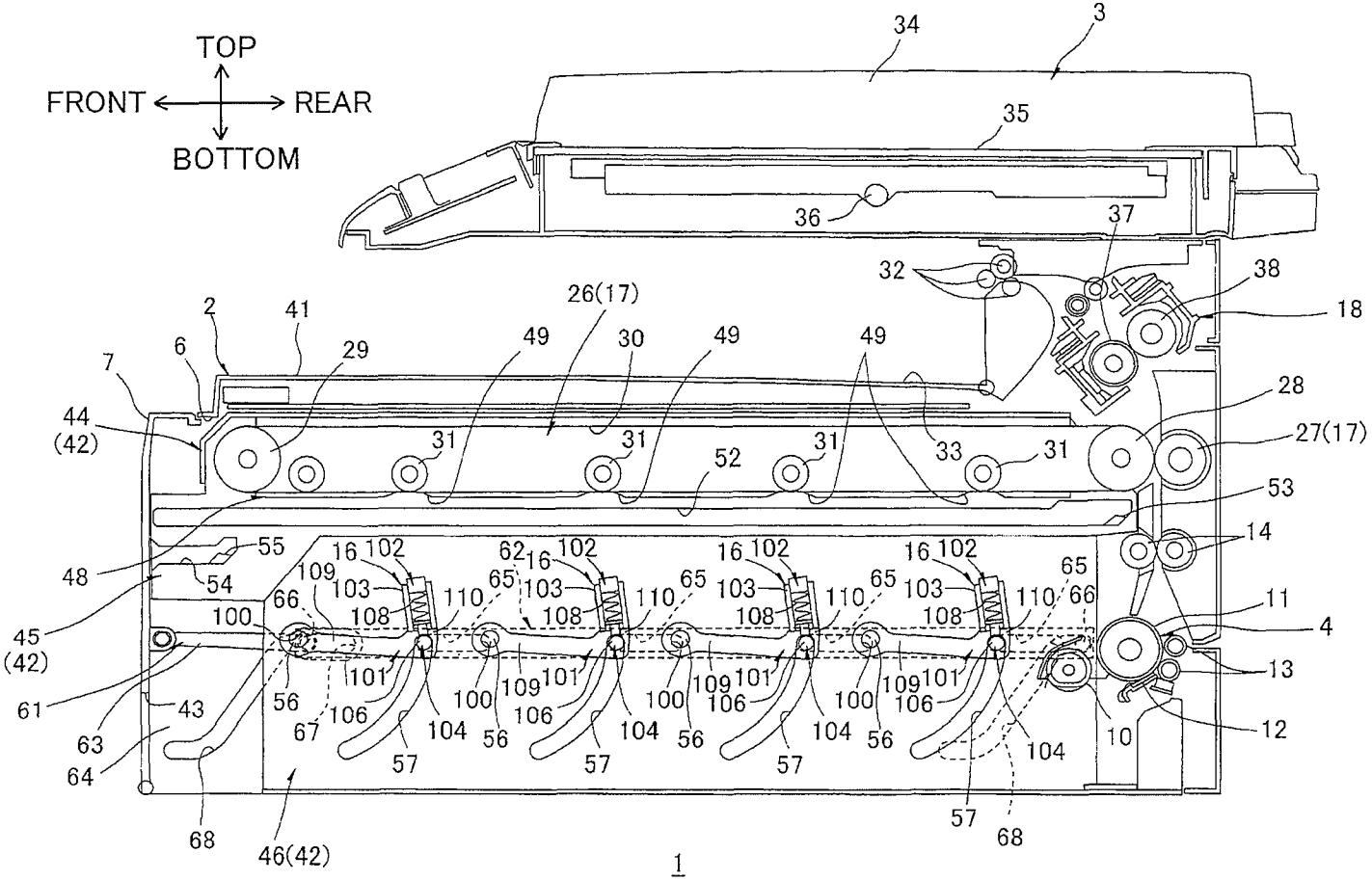
FIG. 3 is an explanatory view illustrating interlocking movement of a front cover and LED units provided in the color printer shown in FIG. 1, in which the front cover is in a closed position and the LED units are in an adjacent position.

As shown in FIGS. 2 and 3, the inner casing 42 is of a hollow rectangular cuboid configuration and elongated in the frontward/rearward direction. The inner casing 42 has a vertical length and a lateral (right to left) length such that the process unit 15, the belt unit 26, and the sheet supply tray 8 can be accommodated therein. The inner casing 42 is accommodated in the outer casing 41. The top, right, and left walls of the inner casing 42 are spaced apart from those of the outer casing 41.

The inner casing 42 includes a belt accommodating section 44 in which the belt unit 26 is accommodated, a process unit supporting section 45 for supporting the process unit 15, and a LED unit supporting section 46 for supporting the four LED units 16.

(2-1) Belt Accommodating Section

The belt accommodating section 44 is disposed at an upper portion of the inner casing 42. The belt accommodating section 44 includes a pair of right and left drum positioning members 48 for positioning each photosensitive drum 20 with respect to the belt unit 26.

Each of the pair of drum positioning members 48 is formed in a generally plate shape extending in the frontward/rearward direction. The pair of drum positioning members 48 is arranged in confrontation with each photosensitive drum 20 at a position outside of a sheet contacting region of each photosensitive drum 20 in the rightward/leftward direction. (Here, the sheet contacting region represents a region of the photosensitive drum 20 that the sheet P contacts.) The pair of drum positioning members 48 is also arranged spaced apart from each other in the rightward/leftward direction, interposing the belt unit 26 therebetween. An upper portion of each drum positioning member 48 is fixed to the top wall of the inner casing 42.

As shown in FIG. 3, each drum positioning member 48 has a lower portion in which four drum positioning recesses 49 corresponding to the four photosensitive drums 20 are formed.

Each drum positioning recess 49 is a substantially U-shaped opened downward. More specifically, the drum positioning recess 49 is depressed upward from a lower edge of the drum positioning member 48. The four drum positioning recesses 49 are juxtaposedly arrayed with and spaced apart from each other in the frontward/rearward direction. Upper portions of right and left ends of the photosensitive drum 20 are respectively retained in the drum positioning recesses 49 formed in the right and left drum positioning members 48.

(2-2) Process Unit Supporting Section

As shown in FIG. 3, the process unit supporting section 45 is disposed immediately below the belt accommodating section 44 at a substantially vertical center of the inner casing 42. The process unit supporting section 45 has right and left side walls, each formed with a first guide groove 52 and a second guide groove 54. The first guide groove 52 serves to guide a rear portion of the process unit 15. The second guide groove 54 serves to guide a front portion of the process unit 15.

The first guide recess 52 has a height (vertical length) allowing a pair of rear roller 85 (described later) of the process unit 15 to be retained therein. The first guide groove 52 is formed in the process unit supporting section 45 across substantially the entire length in the frontward/rearward direction and extends linearly in the frontward/rearward direction. Further, the first guide groove 52 is formed such that a rear portion of the first guide groove 52 has a height (vertical length) greater than a remaining portion thereof and an interior space of the rear portion is expanded upward. A leaf spring 53 (FIG. 3) is provided in the rear portion of the first guide groove 52 so as to curve in an arcuate shape with its convex side facing a top surface of the first guide groove 52.

The leaf spring 53 is a curved metal plate extending in the frontward/rearward direction. The leaf spring 53 has a front end fixed to a bottom surface of the first guide groove 52. More specifically, the leaf spring 53 extends diagonally above and rearward from the front end, then bends rearward and extends in the frontward/rearward direction.

The second guide groove 54 is disposed below a front portion of the first guide recess 52. The second guide groove 54 has a height (vertical length) allowing a front roller 84 of the process unit 15 to be retained therein. The second guide groove 54 extends linearly in the frontward/rearward direction. Further, the second guide groove 54 is formed such that a rear portion of the second guide groove 54 has a height (vertical length) greater than a remaining portion thereof and an interior space of the rear portion is expanded upward. A leaf spring 55 (FIG. 3) is provided in the rear portion of the second guide groove 54 so as to curve in an arcuate shape with its convex side facing a top surface of the second guide groove 54.

The leaf spring 55 has a shape that is the same as the leaf spring 53 provided in the first guide groove 52. The leaf spring 55 has a front end fixed to a bottom surface of the second guide groove 54.

(2-3) LED Supporting Section

The LED unit supporting section 46 is disposed immediate below the process unit supporting section 45 at a lower portion of the inner casing 42.

The LED unit supporting section 46 has right and left side walls, each provided with four support bosses 56. Each support boss 56 functions to support a support arm 101 (described later) of the LED unit 16. Further, each of the right and left side walls of the LED unit supporting section 46 is formed with four LED unit guide grooves 57. Each LED unit guide groove 57 functions to guide a support shaft 106 (described later) of the LED unit 16.

Each right support boss 56 is cylindrical in shape and protrudes inward in the rightward/leftward direction from an inner surface of the right side wall of the LED unit supporting section 46, that is, protrudes leftward from a left surface of a right side wall of the inner casing 42. The four right support bosses 56 are juxtaposedly arrayed with each other in the frontward/rearward direction at regular intervals.

Likewise, each left support boss 56 is cylindrical in shape and protrudes inward in the rightward/leftward direction from an inner surface of the left side wall of the LED unit supporting section 46, that is, protrudes rightward from a right surface of a left side wall of the inner casing 42. The four left support bosses 56 are juxtaposedly arrayed with each other in the frontward/rearward direction.

Figure 6:
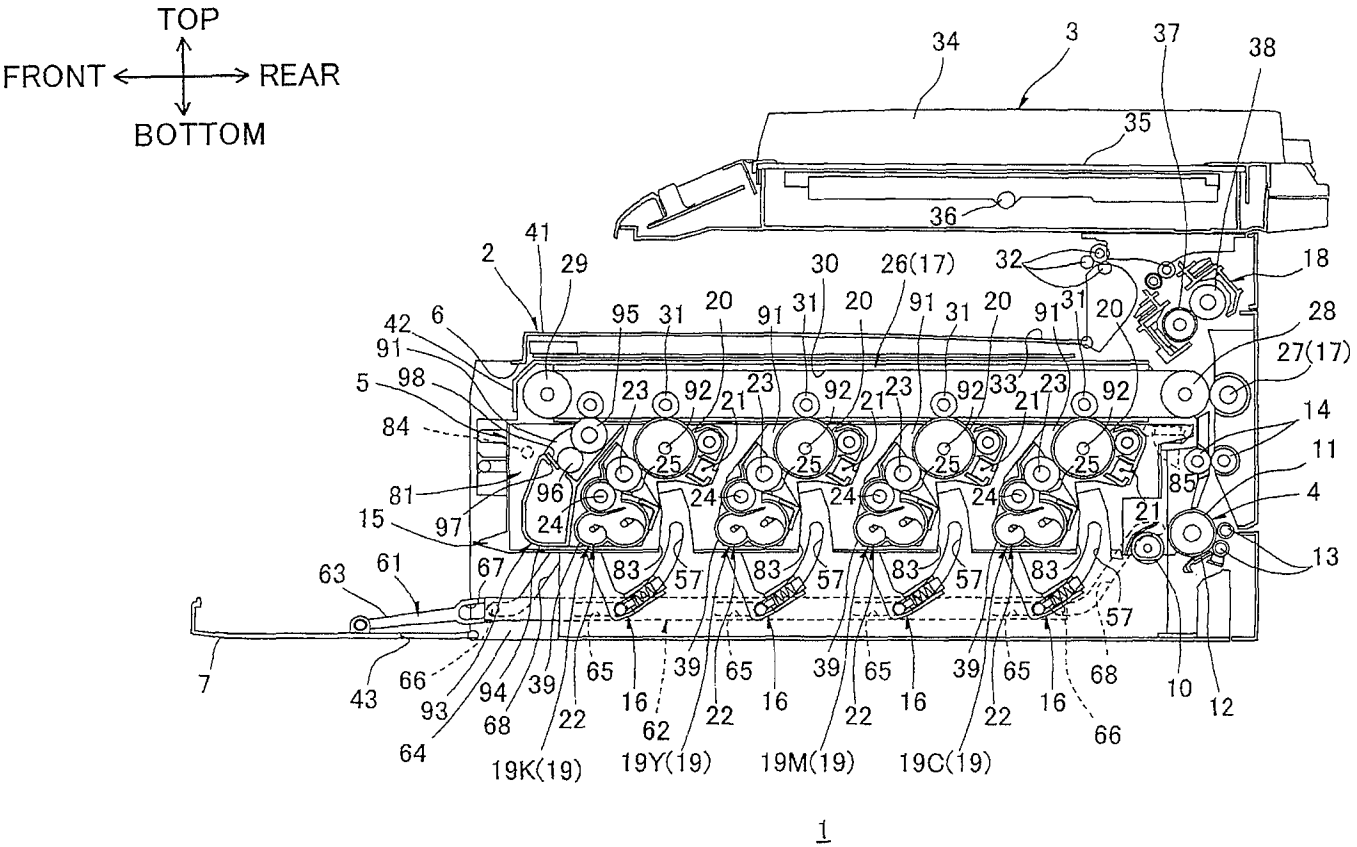
FIG. 6 is an explanatory view illustrating the removal and mounting of the process cartridge relative to the main casing subsequent to FIG. 5, in which the front cover is in the open position and the LED units are in the retracted position.

Each LED unit guide groove 57 is formed in an arcuate shape that is concentric with the corresponding support boss 56 and extends diagonally below and frontward from a rear side of the corresponding support boss 56. The LED unit guide groove 57 has a bottom edge part that is overlapped with the sheet supply tray 8 when projected in the rightward/leftward direction (FIG. 5). In other words, the bottom edge part of the LED unit guide groove 57 is arranged to overlap with the sheet supply tray 8 in the rightward/leftward direction. Further, the LED unit guide groove 57 has a top edge part that is positioned within an LED unit insertion opening 83 (described later) when projected in the rightward/leftward direction (FIG. 6). In other words, the top edge part of the LED unit guide groove 57 is arranged to overlap with the LED unit insertion opening 83 in the rightward/leftward direction.

3. Sheet Supply Tray

As shown in FIGS. 1 and 2, the sheet supply tray 8 is formed in a top substantially rectangular box shape with an open top. The sheet supply tray 8 is detachably accommodated in the lower portion of the inner casing 42 (i.e. a lower portion of the LED unit supporting section 46). The sheet supply tray 8 has a front wall provided with an interference portion 71 at a position confronting an upper periphery of the opening 43 formed in the front cover 7 from front.

The interference portion 71 is an elongated protrusion extending in the rightward/leftward direction and protruding upward from an upper edge of the front wall of the sheet supply tray 8.

4. Process Unit (1) Process Frame

The process unit 15 includes a process frame 81 for integrally retaining the four process cartridges 19 therein.

The process frame 81 is formed in a substantially rectangular box shape with an open top. The process frame 81 is formed with four pairs of right and left cartridge guide recesses 82 (FIG. 2) and four LED unit insertion openings 83.

Each cartridge guide recess 82 is formed in an inner surface of each side wall of the process frame 81 and extends in the vertical direction. Each cartridge guide recess 82 is a depressed portion having a width allowing a rotation shaft 92 (described later) of the corresponding photosensitive drum 20 to be retained therein.

Each LED unit insertion opening 83 is positioned below the corresponding pair of cartridge guide recesses 82. Each LED unit insertion opening 83 is formed in the process frame 81 across the entire length in the rightward/leftward direction such that the right and left side walls of the process frame 81 is cut out upward from bottom edges thereof. More specifically, each LED unit insertion opening 83 is defined by a bottom opening 86 and a pair of right and left side openings 87. The bottom opening 86 is formed in the bottom wall of the process frame 81 across the entire length in the rightward/leftward direction. The right side opening 87 is formed in the right side wall of the process frame 81 so as to be connected to the bottom opening 86. The left side opening 87 is formed in the left side wall of the process frame 81 so as to be connected to the bottom opening 86.

Each of the right and left side walls of the process frame 81 is provided with the front roller 84 and the pair of rear rollers 85. The front roller 84 disposed at the right side wall is rotatably provided in a front portion of the right side wall and protrudes outward (rightward) in the rightward/leftward direction from the right side wall. Likewise, the front roller 84 disposed at the left side wall is rotatably provided in a front portion of the left side wall and protrudes outward (leftward) in the rightward/leftward direction from the left side wall.

Further, the pair of two rear rollers 85 disposed at the right side wall is rotatably provided in a rear portion of the right side wall and protrudes outward (rightward) from the right side wall in the rightward/leftward direction. Likewise, the set of two rear rollers 85 disposed at the left side wall is rotatably provided in a rear portion of the left side wall and protrudes outward (leftward) from the left side wall in the rightward/leftward direction.

(2) Process Cartridge

Each process cartridge 19 has a pair of side plates 91 arranged in confrontation with and spaced apart from each other in the rightward/leftward direction. The photosensitive drum 20, the Scorotron charger 21, and the developing unit 22 are disposed between the side plates 91.

The rotation shaft 92 of the photosensitive drum 20 has right and left ends penetrating the right and left side plates 91 respectively and rotatably supported to the side plates 91. Further, the right and left ends of the rotation shaft 92 protrude outward in the rightward/leftward direction from outer surfaces of the right side plate 91, respectively.

The black process cartridge 19K integrally retains a belt cleaning unit 93. The belt cleaning unit 93 is disposed frontward of the developing unit 22 of the black process cartridge 19K.

The belt cleaning unit 93 includes a waste toner retaining section 94, a scraping roller 96, a scraping blade 98, and a belt cleaning roller 95.

The waste toner retaining section 94 is formed in a generally box-shape having a top opening 97.

The scraping roller 96 is disposed above the opening 97 formed in the waste toner retaining section 94. The scraping roller 96 is arranged in confrontation with the opening 97.

The scraping blade 98 is formed in a generally plate shape extending in the frontward/rearward direction. The scraping blade 98 has a front end (base end) that is fixed to the waste toner retaining section 94 at a front periphery of the opening 97 and a rear end (free end) that contacts the scraping roller 96 from below.

The belt cleaning roller 95 is rotatably supported to an upper portion of the belt cleaning unit 93 so as to contact the scraping roller 96 from above.

The belt cleaning unit 93 is arranged such that the belt cleaning roller 95 contacts the lower portion of the intermediate transfer belt 30 from below. The belt cleaning unit 93 functions to clean waste toner deposited on the surface of the intermediate transfer belt 30 by the belt cleaning roller 95. After the waste toner carried on the belt cleaning roller 95 is supplied to the scraping roller 96, the waste toner carried on the scraping roller 96 is scraped off with the scraping blade 98. Hence, the waste toner is collected in the waste toner retaining section 94.

5. LED Unit

As shown in FIGS. 2 and 3, the four LED units 16 are supported in the LED unit supporting section 46. Within the LED unit supporting section 46, each LED unit 16 is pivotally movable between a retracted position (FIG. 4) in which the LED units 16 are moved away from the photosensitive drums 20 and an adjacent position (FIG. 3) in which each LED unit 16 is adjacent to the corresponding photosensitive drum 20 to expose thereof. In the retracted position, each LED unit 16 is retracted downward so as to be moved away from the corresponding photosensitive drum 20. In other words, each LED unit 16 is retracted (moved) in a direction intersecting with the frontward/rearward direction so as to be moved away from the corresponding photosensitive drum 20. In the adjacent position, the LED unit 16 extends in the vertical direction so as to be located adjacent to the corresponding photosensitive drum 20.

Note that, in the following description with reference to the LED unit 16, directions related to the LED unit 16 will be referred as if the LED unit 16 was in the adjacent position.

Each LED unit 16 includes a pair of right and left support arms 101, an LED array support member 104 disposed between the right and left support arms 101, and an LED array 102 supported to the LED array support member 104.

Each of the right and left support arms 101 is formed of a flat plate shape and also a generally L-shape in a side view, extending in the frontward/rearward direction. Each of the right and left support arms 101 integrally includes an arm portion 109 and a support portion 110.

The right and left arm portions 109 are respectively connected to the right and left support bosses 56. The right and left support portions 110 are adapted to support right and left ends of the LED array support member 104, respectively.

Each arm portion 109 is formed in a generally lever shape extending in the frontward/rearward direction. Each arm portion 109 has a front portion formed with an engagement hole 100.

Each of the engagement holes 100 is a generally circular shaped hole and has a diameter allowing the support boss 56 to be fitted thereinto. Each engagement hole 100 penetrates the corresponding arm portion 109.

Each support portion 110 is formed in a generally lever shape extending upward from a rear end of the arm portion 109.

The LED array supporting member 104 includes the support shaft 106 and an LED array accommodating member 103.

The support shaft 106 is formed in a generally cylindrical shape extending in the rightward/leftward direction. The support shaft 106 has a length in the rightward/leftward direction greater than that of the inner casing 42 (see FIG. 2). Further, the support shaft 106 has a right and left ends each penetrating through the corresponding arm portion 109 of the support arm 101 so that each end of the support shaft 106 protrudes outward from an outer surface of the right support arm 101 in the rightward/leftward direction.

The LED array accommodating member 103 is formed in a generally rectangular frame shape having a bottom wall and elongated in the rightward/leftward direction. The bottom wall of the LED array accommodating member 103 is connected to the support shaft 106. The LED array accommodating member 103 has right and left side walls disposed between the right support portion 110 of the right support arm 101 and the left support portion 110 of the left support arm 101. The LED array accommodating section 103 has an internal dimension in the frontward/rearward direction almost the same as (slightly greater than) an external dimension of the LED array 102 in the frontward/rearward direction. Further, the LED array accommodating member 103 has an internal dimension in the rightward/leftward direction almost the same as (slightly greater than) an external dimension of the LED array 102 in the rightward/leftward direction.

The LED array 102 is formed in a generally quadrangular prism shape and elongated in the rightward/leftward direction. The LED array 102 integrally holds a plurality of LEDs arrayed in the rightward/leftward direction therein. The LED array 102 has a length in the rightward/leftward direction smaller than that of the photosensitive drum 20 but greater than that of the sheet contacting region.

The LED array 102 has right and left ends, each having an LED positioning member 105 for positioning the LED array 102 relative to the corresponding photosensitive drum 20.

Each LED positioning member 105 is formed in a plate shape that is substantially rectangular in a side view. The LED positioning members 105 are arranged to slightly protrude upward from respective right and left edges of the LED array 102. The LED positioning members 105 contact the photosensitive drum 20 from below, thereby positioning the LED array 102 relative to the corresponding photosensitive drum 20 such that the LED array 102 is in confrontation with the corresponding photosensitive drum 20 at an interval corresponding to the protruding length of the LED positioning members 105. It should be noted that the LED positioning member 105 is not limited to the rectangular plate shape. For example, the LED positioning member 105 may be a generally disk shaped roller.

The LED array 102 is movable relative to the LED array accommodating member 103. The LED array 102 has a lower portion that is accommodated in an upper portion of the LED array accommodating member 103. The LED array 102 is resiliently supported to the bottom wall of the LED array accommodating member 103 by a pair of right and left compression springs 108.

More specifically, the right compression spring 108 has one end connected to a right end of the bottom wall of the LED array accommodating member 103 and another end connected to a right end of the LED array 102. Likewise, the left compression spring 108 has one end connected to a left end of the bottom wall of the LED array accommodating member 103 and another end connected to a left end of the LED array 102. With this configuration, the LED array 102 is resiliently supported relative to the bottom wall of the LED array accommodating member 103 via the right and left compression springs 108.

Each LED unit 16 is pivotally movably supported relative to the inner casing 42, by fitting the right and left support bosses 56 of the inner casing 42 into the right and left engagement holes 100 respectively formed in the right and left support arms 101 and by inserting the right and left ends of the support shaft 106 into the right and left LED unit guide grooves 57. Note that the right end of the support shaft 106 is positioned between the inner casing 42 and a right guide member 64 (described later) and the left end of the support shaft 106 is positioned between the inner casing 42 and a left guide member 64 (described later).

Further, each LED unit 16 is constantly biased downward due to its self-weight.

Figure 4:
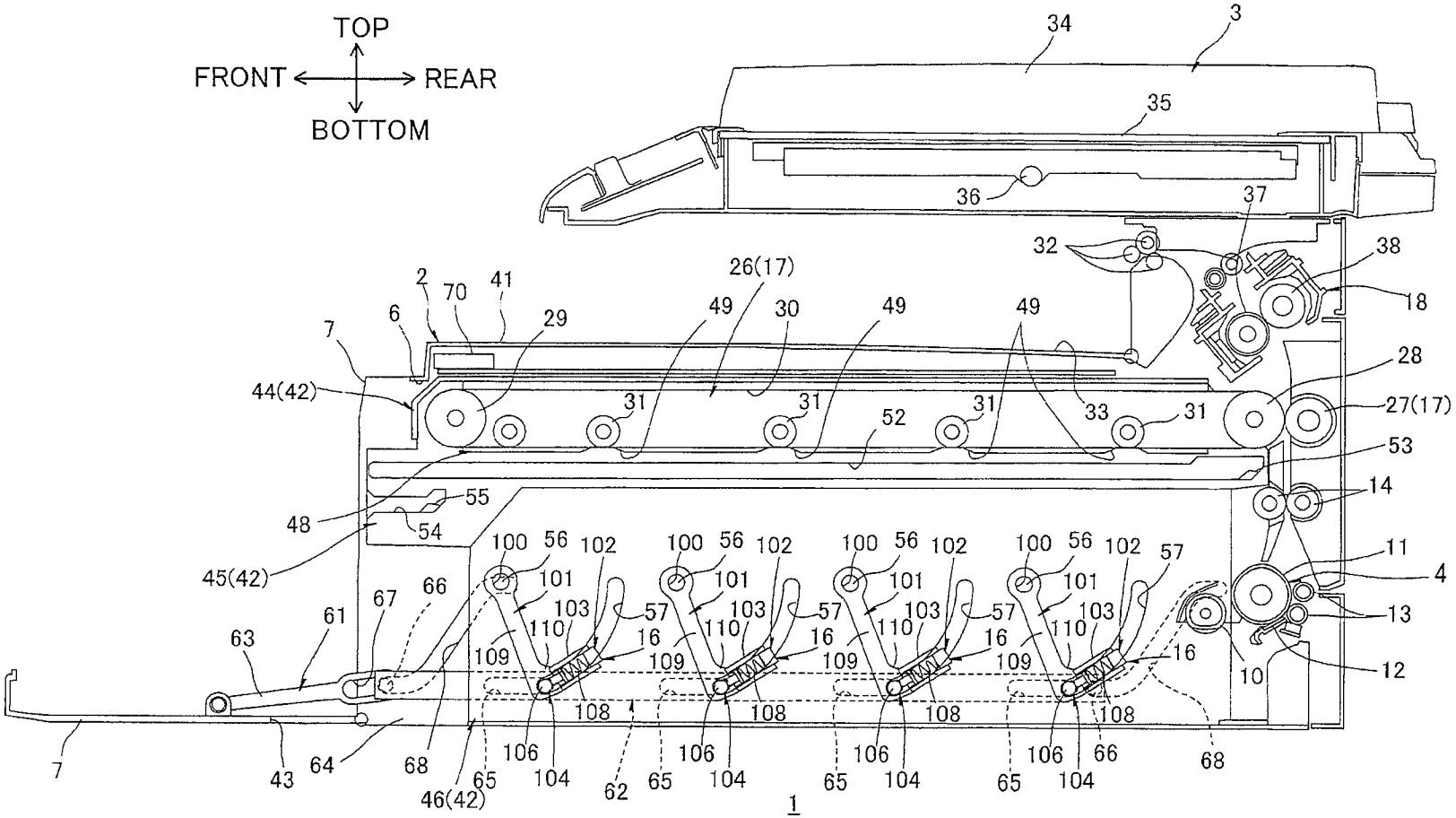
FIG. 4 is an explanatory view illustrating the interlocking movement of the front cover and the LED units provided in the color printer shown in FIG. 1, in which the front cover is in an open position and the LED units are in a retracted position.

When the LED unit 16 is in the adjacent position, the right and left ends of the support shaft 106 are positioned in the top edges of the right and left LED unit guide grooves 57, respectively (FIG. 3). When the LED unit 16 is in the retracted position, the right and left ends of the support shaft 106 are positioned in the bottom edges of the right and left LED unit guide grooves 57, respectively (FIG. 4).

6. Interlocking Mechanism (1) Structure of Interlocking Mechanism

Within the main casing 2, a pair of right and left interlocking mechanisms 61 are provided. The pair of right and left interlocking mechanisms 61 is adapted to move the four LED units 16 in interlocking relation to the movement of the front cover 7. The right interlocking mechanism 61 is provided at the right side wall of the inner casing 42 and disposed between the inner casing 42 and the outer casing 41. The left interlocking mechanism 61 is provided at the left side wall of the inner casing 42 and disposed between the inner casing 42 and the outer casing 41.

Each of the right and left interlocking mechanisms 61 includes a first connection member 62 for connecting the four LED units 16 to each other, a second connection member 63 (FIG. 3) for connecting the first connection member 62 to the front cover 7, and the guide member 64 for guiding the movement of the first connection member 62.

The first connection member 62 is formed in a generally flat plate shape and elongated in the frontward/rearward direction. The first connection member 62 is formed with four through-holes 65 into which the four support shafts 106 of the four LED units 16 are inserted respectively. Further, the first connection member 62 is provided with a pair of front and rear guide bosses 66 respectively fitted into a pair of front and rear connection member guide grooves 68 (described later) formed in the guide member 64.

Each through-hole 65 is an elongated hole extending in the frontward/rearward direction. The four right through-holes 65 are juxtaposedly arranged with each other at regular intervals in the frontward/rearward direction. Each right through-hole 65 has a vertical length allowing the right end of the support shaft 106 of the LED unit 16 to be inserted thereinto. Likewise, the four left through-holes 65 are juxtaposedly arranged with each other at regular intervals in the frontward/rearward direction. Each left through-hole 65 has a vertical length allowing the left end of the 106 of the LED unit 16 to be inserted thereinto.

Each guide boss 66 is formed in a generally cylindrical shape. The pair of front and rear guide bosses 66 of each first connection member 62 protrudes outward in the rightward/leftward direction from an outer surface of each first connection member 62 in the rightward/leftward direction. The front guide boss 66 is provided at a front end portion of each first connection member 62 and the rear guide boss 66 is disposed at a rear end portion of each first connection member 62.

The second connection member 63 is formed in a generally lever shape and elongated in the frontward/rearward direction. The second connection member 63 has a front end portion that is swingably connected to the front cover 7. Further, each second connection member 63 has a rear end portion formed with a connection hole 67 to which the front guide boss 66 of the first connection member 62 is connected.

The connection hole 67 is an elongated hole extending in the frontward/rearward direction. The connection hole 67 has a vertical length allowing the front guide boss 66 of the first connection member 62 to be inserted thereinto.

The guide member 64 is formed in a generally flat plate shape elongated in the frontward/rearward direction and bent inward from its top and bottom edges in the rightward/leftward direction, thereby covering the exterior of the LED unit supporting section 46 in the rightward/leftward direction. With this configuration, a generally rectangular shaped space in a front view is defined by the right side wall of the inner casing 42 and the right guide member 64 at a position rightward of the LED unit supporting section 46. Another generally rectangular shaped space in a front view is also defined by the left side wall of the inner casing 42 and the left guide member 64 at a position leftward of the LED unit supporting section 46.

Each guide member 64 is formed with the pair of front and rear connection member guide grooves 68 for guiding the pair of front and rear guide bosses 66 of each first connection member 62.

Each of the front and rear connection member guide grooves 68 formed in the guide members 64 is depressed outward from an inner surface of the guide member 64 in the rightward/leftward direction. Further, each connection member guide groove 68 is formed in a generally crank-shape (S-shape) in a side view extending diagonally below and frontward from an upper rear side. Each connection member guide groove 68 has a width allowing the corresponding guide boss 66 of the first connection member 62 to be inserted thereinto. Further, each connection member guide groove 68 has a top edge that is arranged to overlap with that of each LED unit guide groove 57 when projected in the frontward/rearward direction and a bottom edge that is arranged to overlap with that of each LED unit guide groove 57 when projected in the frontward/rearward direction (FIG. 3).

The front guide boss 66 of each first connection member 62 is inserted into the front connection member guide groove 68 formed in the guide member 64 through the connection hole 67 formed in the second connection member 63. The rear guide boss 66 of each first connection member 62 is also inserted into the rear connection member guide groove 68 formed in the guide member 64. The first connection members 62 are thus connected to the front cover 7 through the second connection members 63 and also supported to the guide members 64.

When the front cover 7 is in the closed position, each first connection member 62 is positioned at a first position (FIG. 3) in which the corresponding front and rear guide bosses 66 are respectively positioned at upper rear end portions of the corresponding front and rear connection member guide grooves 68. At this time, each first connection member 62 confronts the top edge of each LED unit guide groove 57 in the rightward/leftward direction. The top edge of each LED unit guide groove 57 is arranged to overlap with a front edge of each through-hole 65 in the rightward/leftward direction.

Further, when the front cover 7 is moved to the open position from the closed position, each first connection member 62 is pulled diagonally below and frontward by the corresponding second connection member 63 and slidingly moved diagonally below and frontward while each pair of front and rear guide bosses 66 is guided by the corresponding pair of front and rear connection member guide grooves 68.

Further, when the front cover 7 reaches the open position, each first connection member 62 is positioned at a second position (FIG. 4) in which the corresponding front and rear guide bosses 66 are respectively positioned at lower front end portions of the corresponding front and rear connection member guide grooves 68. At this time, each first connection member 62 confronts the bottom edge of each LED unit guide groove 57 in the rightward/leftward direction. The bottom edge of each LED unit guide groove 57 is arranged to overlap with a rear edge of each through-hole 65 in the rightward/leftward direction.

When the front cover 7 is moved to the closed position from the open position, each first connection member 62 is pushed diagonally above and rearward by the corresponding second connection member 63 and slidingly moved diagonally above and rearward while each pair of front and rear guide bosses 66 is guided by the corresponding pair of front and rear connection member guide grooves 68. As a result, each first connection member 62 is moved to the first position from the second position.

(2) Interlocking Movement of Front Cover and Each LED Unit

As shown in FIG. 2, each LED unit 16 is connected to the pair of right and left interlocking mechanisms 61, by inserting the right and left ends of the corresponding support shaft 106 into the corresponding through-holes 65 at a position between the inner casing 42 and the guide member 64.

When the front cover 7 is in the closed position and each first connection member 62 is in the first position, the right and left ends of the support shaft 106 of each LED unit 16 are respectively retained by the right and left first connection members 62 at the respective top edges of the corresponding pair of right and left LED unit guide grooves 57. At this time, each LED unit 16 is in the adjacent position (FIG. 3).

At this time, as shown in FIG. 5, each LED unit 16 is positioned inside the corresponding LED unit insertion opening 83 of the process unit 15.

Then, when the front cover 7 is moved to the open position from the closed position, in conjunction with the movement of each first connection member 62 from the first position to the second position, each LED unit 16 is pivotally moved in a clockwise direction as viewed from a right side due to its self-weight so as to be retracted downward.

Further, as shown in FIG. 4, when the front cover 7 reaches the open position and each first connection member 62 is in the second position, the right and left ends of the support shaft 106 of each LED unit 16 are respectively retained by the right and left first connection members 62 at the respective bottom edges of the corresponding pair of the right and left LED unit guide grooves 57. At this time, each LED unit 16 is in the retracted position (FIG. 4).

At this time, as shown in FIG. 6, each LED unit 16 is retracted (moved) downward from the corresponding LED unit insertion opening 83 of the process unit 15 such that the LED units 16 do not interfere with the process unit 15 in the rightward/leftward direction when the process unit 15 is mounted in or removed from the main casing 2.

Then, when the front cover 7 is moved to the closed position from the open position, in conjunction with the movement of each first connection member 62 from the second position to the first position, each LED unit 16 is pivotally moved in a counterclockwise direction as viewed from a right side about the corresponding pair of right and left support bosses 56 against gravity. As a result, each LED unit 16 is moved toward the adjacent position from the retracted position.

7. Removal and Mounting of Process Cartridge Relative to Main Casing

To remove the process cartridge 19 from the main casing 2 or to mount the process cartridge 19 in the main casing 2, initially, the front cover 7 is moved to the open position to pull the process unit 15 outward from the main casing 2.

When the sheet supply tray 8 is mounted in the main casing 2, the interference portion 71 of the sheet supply tray 8 confronts the upper periphery of the opening 43 formed in the front cover 7 from front. Because of this structure, even if the user intends to move the front cover 7 to the open position from the closed position, the interference portion 71 interferes with the front cover 7. Accordingly, the movement of the front cover 7 to the open position is restricted by the interference portion 71.

As shown in FIG. 5, the user initially pulls the sheet supply tray 8 frontward to remove the sheet supply tray 8 from the main casing 2. As a result of removal of the sheet supply tray 8 from the main casing 2, a space is formed at a position below the process unit 15.

Next, to remove the process unit 15 from the main casing 2, as shown in FIG. 6, the front cover 7 is moved to the open position from the closed position to open the opening 6.

Then, as described above, in response to the movement of the front cover 7 to the open position from the closed position, each LED unit 16 is moved to the retracted position so as to be moved to the space formed by removing the sheet supply tray 8 from the main casing 2.

Figure 7:
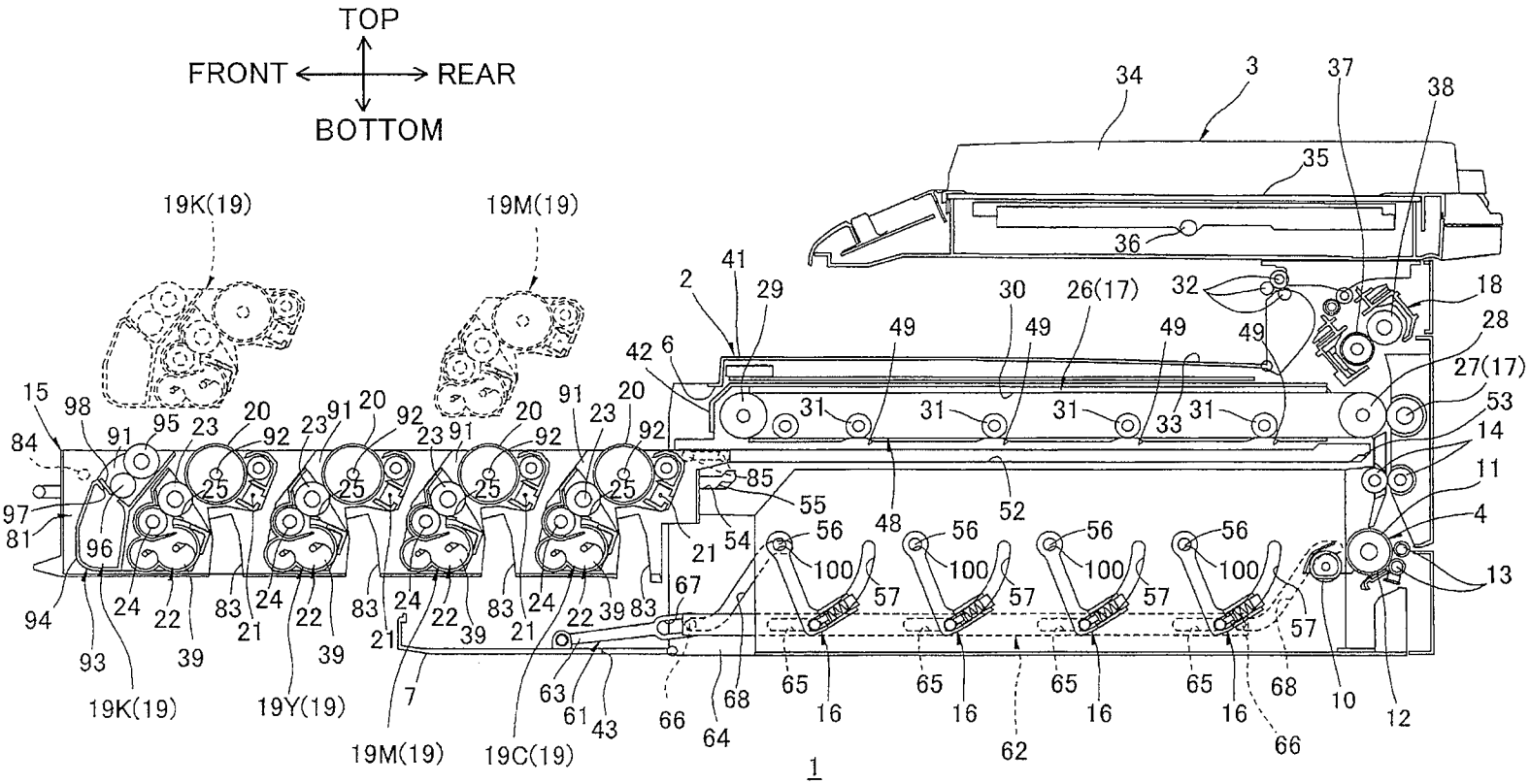
FIG. 7 is an explanatory view illustrating the removal and mounting of the process cartridge relative to the main casing subsequent to FIG. 6, in which the process unit is in a pulled-out position.

Subsequently, as shown in FIG. 7, the process unit 15 is pulled frontward from the main casing 2 through the opening 6. At this time, since the LED units 16 is in the retracted position, the LED units 16 do not interfere with the movement of the process unit 15 in the rightward/leftward direction.

Then, each rearmost roller 85 of the process unit 15 is separated from the corresponding leaf spring 53 at the rear portion of the corresponding first guide groove 52. Each front roller 84 of the process unit 15 is also separated from the corresponding leaf spring 55 at the rear portion of the corresponding second guide groove 54. As a result, the process unit 15 is moved downward so that each photosensitive drum 20 is separated from the lower portion of the intermediate transfer belt 30.

Subsequently, when the process unit 15 is further pulled frontward, the process unit 15 is guided by the right and left first guide grooves 52 and the right and left second guide grooves 54, and pulled outward from the main casing 2 while maintaining a slight gap between the lower portion of the intermediate transfer belt 30 and the process unit 15.

Subsequently, the process cartridge 19 is removed from the pulled-out process unit 15. More specifically, to remove the process cartridge 19 from the process unit 15, the process cartridge 19 is pulled upward. To mount the process cartridge 19 in the process unit 15, the process cartridge 19 is positioned above the process frame 81 so that the right and left ends of the rotation shaft 92 of the photosensitive drum 20 are respectively disposed above the right and left cartridge guide recesses 82. Then, the process cartridge 19 is moved downward to be inserted into the process frame 81 from above.

By performing, in reverse order, the above-described operation for removing the process unit 15 from the main casing 2, the process unit 15 is mounted in the main casing 2.

More specifically, the process unit 15 is inserted into the main casing 2 along the first guide grooves 52 and the second guide grooves 54.

At this time, the process unit 15 is guided by the first guide grooves 52 and the second guide grooves 54 to be inserted into the main casing 2, while maintaining a slight gap between the lower portion of the intermediate transfer belt 30 and the process unit 15.

Then, each rearmost roller 85 of the process unit 15 rides up over the corresponding leaf spring 53 at the rear portion of the corresponding first guide groove 52. Each front roller 84 of the process unit 15 also rides up over the corresponding leaf spring 55 at the rear portion of the corresponding second guide groove 54. The process unit 15 is thus moved upward so that each photosensitive drum 20 is brought into contact with the lower portion of the intermediate transfer belt 30.

As a result, the process unit 15 is mounted in the main casing 2 so as to be constantly biased upward by the biasing forces of the leaf spring 53 and the leaf spring 55.

Then, after the front cover 7 is moved to the closed position from the open position, the sheet supply tray 8 is mounted in the main casing 2 through the opening 43 of the front cover 7.

8. Operations and Effects (1) In the color printer 1 according to the first embodiment of the present invention, as shown in FIG. 6, each LED unit 16 is moved to the space formed by removing the sheet supply tray 8 from the main casing 2 to be moved to the retracted position such that the LED units 16 do not interfere with the process unit 15, in which the photosensitive drums 20 are retained, in the rightward/leftward direction when the process unit 15 is mounted in or removed from the main casing 2.

Hence, it is not necessary to provide a separate space for retracting the LED units 16 thereinto. The LED units 16 can be moved to the space formed by removing the sheet supply tray 8 from the main casing 2 so as to be moved away from the corresponding photosensitive drums 20.

Consequently, the color printer 1 can be made more compact, thereby saving a space for placing the color printer 1.

(2) Further, in the color printer 1 according to the first embodiment of the present invention, as shown in FIGS. 3 and 4, the main casing 2 is provided with the pair of right and left interlocking mechanisms 61. The pair of interlocking mechanisms 61 is adapted to move each LED unit 16 to the retracted position from the adjacent position in response to the movement of the front cover 7 to the open position from the closed position and also to move each LED unit 16 to the adjacent position from the retracted position in response to the movement of the front cover 7 to the closed position from the open position.

Hence, by moving the front cover 7 to the open position, each LED unit 16 can be reliably moved away from the corresponding photosensitive drum 20.

As a result, interference of the LED units 16 with the process unit 15 when the process unit 15 is moved relative to the main casing 2 can be reliably prevented.

Further, by moving the front cover 7 to the closed position, each LED unit 16 can be reliably moved to the adjacent position.

(3) Further, in the color printer 1 according to the first embodiment of the present invention, as shown in FIG. 1, the sheet supply tray 8 interferes with the front cover 7 to restrict the movement of the front cover 7 to the open position when the sheet supply tray 8 is mounted in the main casing 2.

This structure can prevent each LED unit 16 from being moved to the retracted position while the sheet supply tray 8 is mounted in the main casing 2.

Consequently, interference of the sheet supply tray 8 with the LED units 16 can be prevented.

(4) Further, in the color printer 1 according to the first embodiment of the present invention, as shown in FIG. 1, when the process unit 15 is in the mounted position, the pickup roller 10 is arranged to overlap with the process unit 15 in the frontward/rearward direction.

More specifically, the pickup roller 10 disposed above the sheet supply tray 8 is disposed rearward of the process unit 15.

Therefore, the process unit 15 and the sheet supply tray 8 can be disposed adjacent to each other in the vertical direction. As a result, the color printer 1 can be downsized in the vertical direction.

9. Second Embodiment

A color printer 111 as an image forming device according to a second embodiment of the present invention will be described while referring to FIGS. 8 to 13.

In the following description, parts and components appearing in the second embodiment and the same as those in the first embodiment will be designated by the same reference numerals as those in the first embodiment to avoid duplicating description, and only parts and components differing from those of the above-described first embodiment will be described.

In the above-described first embodiment, the process unit 15 retains the four photosensitive drums 20, the four Scorotron chargers 21, and the four developing units 22. Further, the four LED units 16 are moved to the space formed by removing the sheet supply tray 8 from the main casing 2, thereby moving each LED unit 16 to the retracted position.

Figure 8:
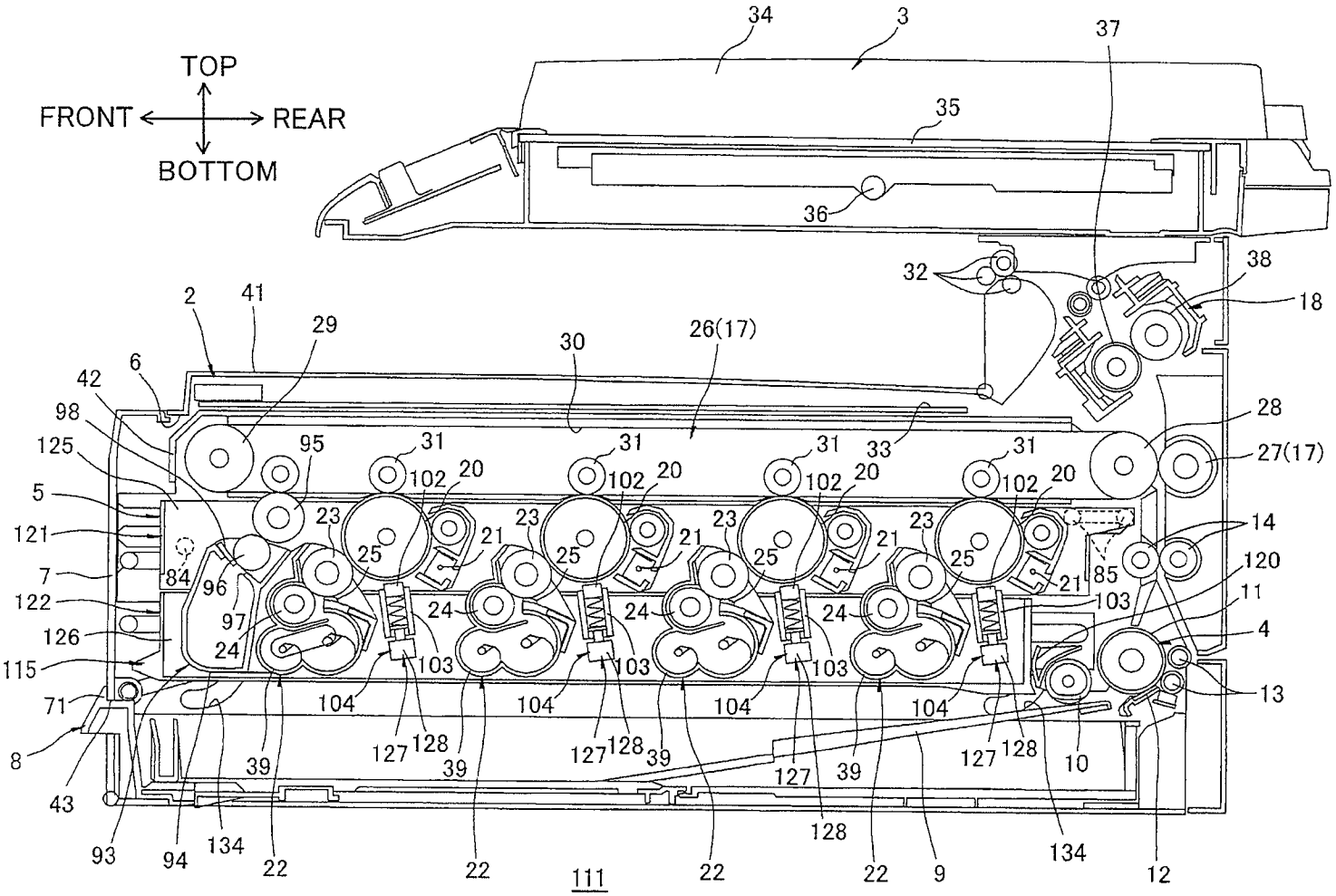
FIG. 8 is a cross-sectional view of a color printer as an image forming device according to a second embodiment of the present invention.

On the other hand, in the second embodiment, as shown in FIG. 8, the color printer 111 includes a process unit 115 that has a drum drawer 121 and a developing drawer 122. The drum drawer 121 retains the four photosensitive drums 20 and the four Scorotron chargers 21. The developing drawer 122 retains the four developing units 22 and four LED units 127.

Figure 11:
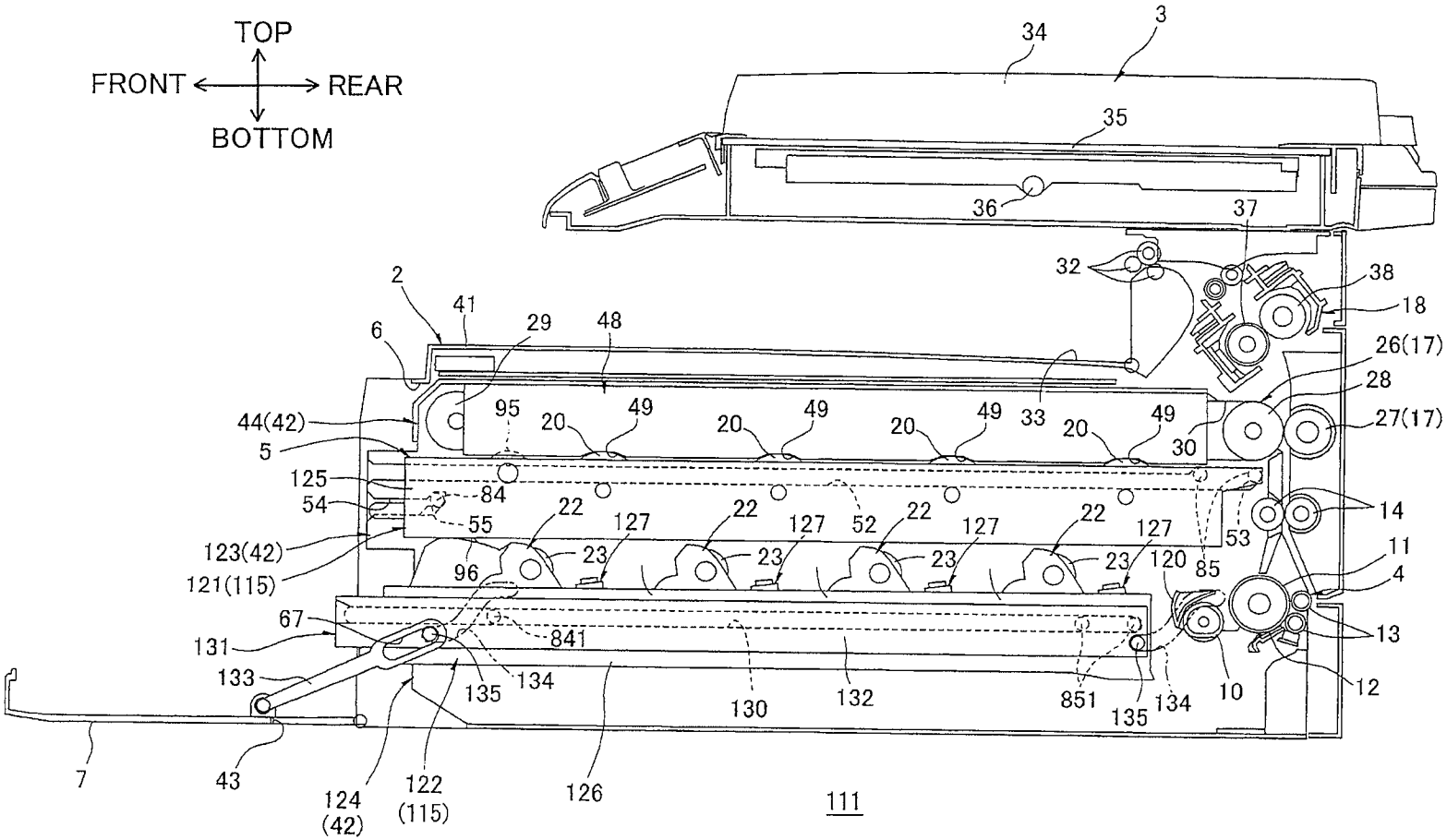
FIG. 11 is an explanatory view illustrating removal and mounting of a drum drawer and a developing drawer relative to a main casing provided in the color printer shown in FIG. 8, in which the front cover is in the open position and the developing drawer is in a retracted position after a sheet supply tray has been removed from the main casing.

As shown in FIG. 11, the developing drawer 122 is moved to a space formed by removing the sheet supply tray 8 from the main casing 2, thereby moving the developing drawer 122 to a retracted position.

(1) Process Unit (1-1) Drum Drawer

As shown in FIG. 8, the drum drawer 121 includes a drum drawer frame 125. The drum drawer frame 125 is formed in a rectangular frame shape having top and bottom openings. Within the drum drawer frame 125, the four photosensitive drums 20 and the four Scorotron chargers 21 are integrally retained.

The four photosensitive drums 20 are juxtaposedly arranged with each other at regular intervals in the frontward/rearward direction. More specifically, a black photosensitive drum 20K, a yellow photosensitive drum 20Y, a magenta photosensitive drum 20M, and a cyan photosensitive drum 20C are aligned in this order from front to rear.

Each Scorotron charger 21 is disposed diagonally below and rearward of the corresponding photosensitive drum 20, and confronts but does not contact the corresponding photosensitive drum 20, in the same manner as the first embodiment.

The drum drawer 121 is provided with the belt cleaning roller 95 at a position frontward of the black photosensitive drum 20K.

The belt cleaning roller 95 is rotatably supported to the drum drawer frame 125 so as to contact the lower portion of the intermediate transfer belt 30 from below.

The drum drawer frame 125 has right and left side walls, each provided with the front roller 84 and the set of two rear rollers 85. The front roller 84 provided in the right side wall is rotatably provided in a front portion of the right side wall and protrudes outward (rightward) in the rightward/leftward direction from the right side wall. Likewise, the front roller 84 disposed at the left side wall is rotatably provided in a front portion of the left side wall and protrudes outward (leftward) in the rightward/leftward direction from the left side wall.

Further, the set of two rear rollers 85 disposed at the right side wall is rotatably provided in a rear portion of the right side wall and protrudes outward (rightward) from the right side wall in the rightward/leftward direction. The set of two rear rollers 85 disposed at the left side wall is rotatably provided in a rear portion of the left side wall and protrudes outward (leftward) from the left side wall in the rightward/leftward direction.

(1-2) Developing Drawer

The developing drawer 122 includes a developing drawer frame 126. The developing drawer frame 126 is formed in a rectangular frame shape having a bottom wall and a top open. Within the developing drawer frame 126, the four developing units 22 and the four LED units 127 are integrally retained.

The developing drawer 122 is supported in a developing drawer supporting section 124 (described later) of the inner casing 42 and movable between a retracted position (FIG. 11) and an adjacent position (FIG. 8). In the retracted position, the developing drawer 122 is retracted downward so as to be moved away from the four photosensitive drums 20. In the adjacent position, the developing drawer 122 is located adjacent to the four photosensitive drums 20 so that the four developing rollers 23 are brought into contact with the corresponding photosensitive drums 20 from below. Further, the developing drawer 122 is arranged to overlap with the pickup roller 10 in the frontward/rearward direction when the developing drawer 122 is in the adjacent position.

Each developing unit 22 is disposed diagonally below and frontward of the corresponding photosensitive drum 20, in the same manner as the first embodiment. The four developing units 22 are juxtaposedly arranged with each other at regular intervals in the frontward/rearward direction. More specifically, a black developing unit 22K, a yellow developing unit 22Y, a magenta developing unit 22M, and a cyan developing unit 22C are aligned in this order from front to rear. Further, each developing unit 22 is detachable and mountable relative to the developing drawer frame 126 in the vertical direction while guided by guide recesses (not shown) formed in the developing drawer frame 126.

The black developing unit 22K is integrally provided with the waste toner retaining section 94, the scraping roller 96, and the scraping blade 98 at a position frontward of the black developing unit 22K.

The waste toner retaining section 94 is formed in a generally box-shape having the top opening 97.

The scraping roller 96 is arranged in confrontation with the opening 97 formed in the waste toner retaining section 94 at a position above the opening 97. Further, the scraping roller 96 contacts the belt cleaning roller 95 of the drum drawer 121 from below.

The scraping blade 98 is formed in a generally plate shape extending in the frontward/rearward direction. The scraping blade 98 has a front end (base end) that is fixed to the waste toner retaining section 94 at a front periphery of the opening 97 and a rear end (free end) that contacts the scraping roller 96 from below.

The waste toner retaining section 94, the scraping roller 96, the scraping blade 98 and the belt cleaning roller 95 constitute the belt cleaning unit 93.

The belt cleaning unit 93 functions to clean waste toner deposited on the surface of the intermediate transfer belt 30 by the belt cleaning roller 95. After the waste toner carried on the belt cleaning roller 95 is supplied to the scraping roller 96, the waste toner carried on the scraping roller 96 is scraped off with the scraping blade 98. Hence the waste toner is collected in the waste toner retaining section 94.

Each LED unit 127 has a configuration similar to the LED unit 16 according to the first embodiment except that the LED unit 127 is provided with a support beam 128 in place of the support shaft 106 and is not provided with the support arm 101. Each LED unit 127 is fixed to the developing drawer frame 126 of the developing drawer 122 at a position rearward of the corresponding developing unit 22. The support beam 128 is formed in a generally quadrangular prism shape.

More specifically, each LED unit 127 includes the LED array 102 and the LED array support member 104 provided with the support beam 128. Each LED unit 127 is fixed to the developing drawer frame 126 of the developing drawer 122 at right and left ends of the support beam 128 of the LED array support member 104 so that the LED array 102 exposes the corresponding photosensitive drum 20 from below.

The developing drawer frame 126 has right and left side walls, each provided with a front roller 841 and a pair of rear rollers 851. The front roller 841 disposed at the right side wall is provided in a front portion of the right side wall and protrudes outward (rightward) in the rightward/leftward direction from the right side wall. The front roller 841 disposed at the left side wall is rotatably provided in a front portion of the left side wall and protrudes outward (leftward) in the rightward/leftward direction from the left side wall.

Further, the pair of two rear rollers 851 disposed at the right side wall is rotatably provided in a rear portion of the right side wall and protrudes outward (rightward) in the rightward/leftward direction from the right side wall. The pair of two rear rollers 851 disposed at the left side is rotatably provided in a rear portion of the left side wall and protrudes outward (leftward) in the rightward/leftward direction from the left side wall.

(2) Main Casing

Figure 9:
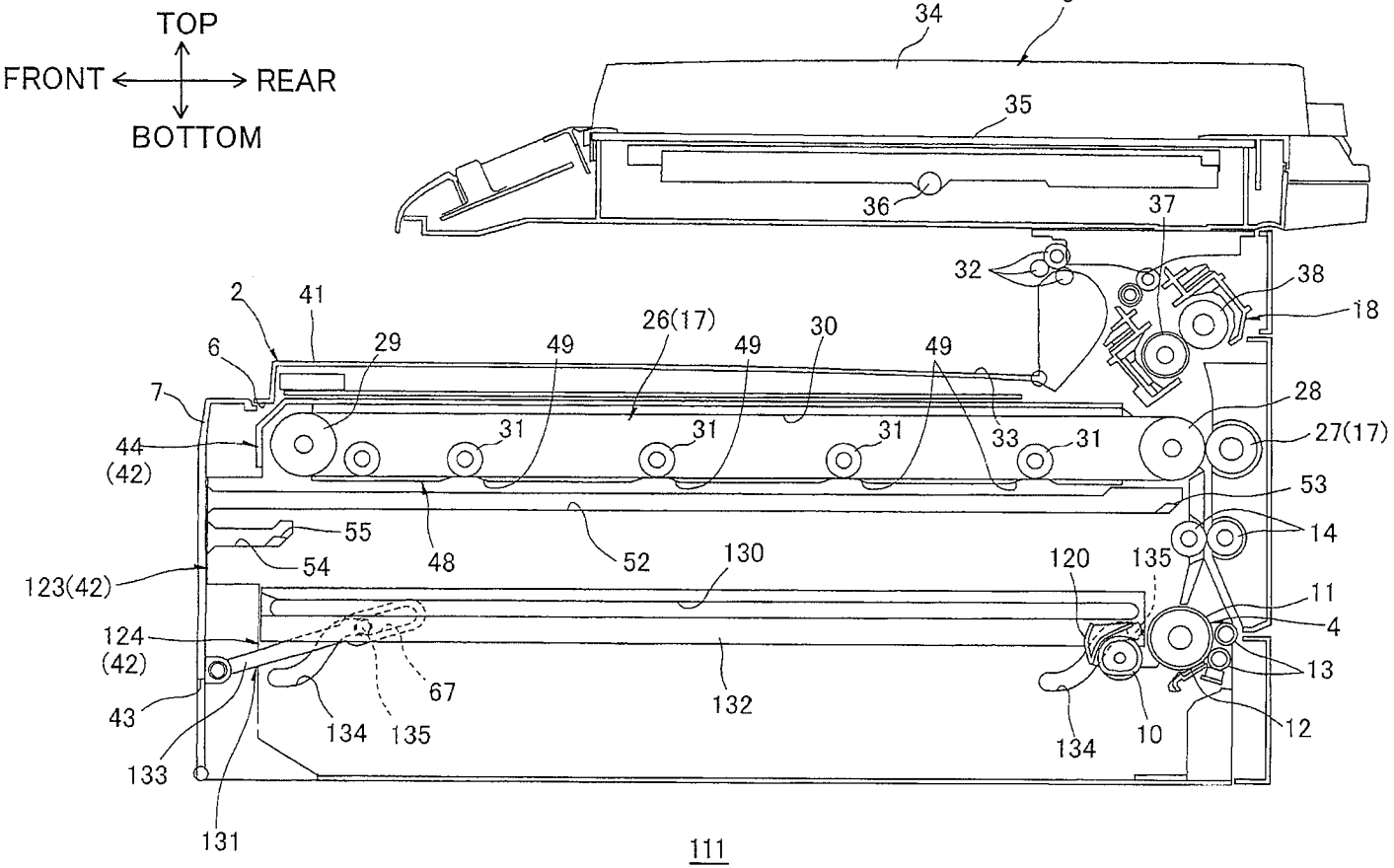
FIG. 9 is an explanatory view illustrating interlocking movement of a front cover and a support member provided in the color printer shown in FIG. 8, in which the front cover is in a closed position and the support member is in a first position.

As shown in FIG. 9, the inner casing 42 of the main casing 2 includes a drum drawer supporting section 123 for supporting the drum drawer 121 and the developing drawer supporting section 124 for supporting the developing drawer 122 at positions below the belt accommodating section 44.

(2-1) Drum Drawer Supporting Section

The drum drawer supporting section 123 has a configuration similar to the process unit supporting section 45 according to the first embodiment.

More specifically, the drum drawer supporting section 123 is disposed immediately below the belt accommodating section 44 at a substantially vertical center of the inner casing 42. Further, the drum drawer supporting section 123 has a right and left side walls, each formed with the first guide groove 52 for guiding a rear portion of the drum drawer 121 (the rear rollers 85) and the second guide groove 54 for guiding a front portion of the drum drawer 121 (the front roller 84).

(2-2) Developing Drawer Supporting Section

The developing drawer supporting section 124 is disposed immediately below the drum drawer supporting section 123 at the lower portion of the inner casing 42. Within the developing drawer supporting section 124, a pair of right and left interlocking mechanisms 131 is provided. The pair of right and left interlocking mechanisms 131 is adapted to move the developing drawer 122 in interlocking relation to the movement of the front cover 7. Further, the developing drawer supporting section 124 has right and left side walls, each formed with a pair of front and rear support member guide grooves 134 for guiding a support member 132 of the interlocking mechanism 131.

Each of the right and left interlocking mechanisms 131 includes the support member 132 for slidably supporting the developing drawer 122 in the frontward/rearward direction and a connection member 133 for connecting the support member 132 to the front cover 7.

The support member 132 is formed in a generally flat plate shape and elongated in the frontward/rearward direction. The support member 132 has a length in the frontward/rearward direction greater than that of the developing drawer 122. The support member 132 is formed with a third guide groove 130 for guiding the front roller 841 and the pair of rear rollers 851 of the developing drawer 122. Further, the support member 132 is provided with a pair of front and rear guide bosses 135 inserted into the pair of front and rear support member guide grooves 134.

The third guide groove 130 has a height (vertical length) allowing the front roller 841 and the rear roller 851 to be retained therein. The third guide groove 130 is formed in the support member 132 across the entire length in the frontward/rearward direction and extends linearly in the frontward/rearward direction.

Each guide boss 135 is formed in a generally cylindrical shape. The pair of front and rear guide bosses 135 of each support member 132 protrudes outward (rightward or leftward) from an outer surface of the right support member 132 in the rightward/leftward direction. The front guide boss 135 of each support member 132 is disposed at a front end portion of the support member 132 and the rear guide boss 135 of each support member 132 is disposed at a rear end portion of the support member 132.

The connection member 133 has a configuration similar to the second connection member 63 according to the first embodiment. More specifically, the connection member 133 is formed in a generally lever shape and elongated in the frontward/rearward direction. The connection member 133 has a front end portion that is swingably connected to the front cover 7. Further, the connection member 133 has a rear end portion formed with the connection hole 67 to which the front guide boss 135 of the support member 132 is connected (inserted).

Each of the front and rear support member guide grooves 134 formed in each right side wall of the developing drawer supporting section 124 is depressed outward (rightward or leftward) from an inner surface of each side wall in the rightward/leftward direction. Further, each support member guide groove 134 is formed in a generally crank-shape (S-shape) in a side view extending diagonally below and frontward from an upper rear side. Each support member guide groove 134 has a width allowing the corresponding guide boss 135 of the support member 132 to be inserted thereinto.

Each support member guide groove 134 has a vertical length greater than a protruding length of each developing unit 22. The protruding length of the developing unit 22 represents a length of part of the developing unit 22 that protrudes upward from the developing drawer frame 126 to the drum drawer frame 125. Further, each support member guide groove 134 has a top edge that is positioned below the drum drawer 121 (FIG. 12) and a bottom edge that is positioned immediate above the sheet supply tray 8 (FIG. 8) when projected in the rightward/leftward direction. Further, the top edge of each rear support member guide groove 134 is arranged to overlap with the pickup roller 10 when projected in the rightward/leftward direction.

The front guide boss 135 of the support member 132 is inserted into the front support member guide groove 134 formed in the side wall of the developing drawer supporting section 124 through the connection hole 67 formed in the connection member 133. The rear guide boss 135 of the support member 132 is also inserted into the rear support member guide groove 134 formed in the side wall of the developing drawer supporting section 124. The support member 132 is thus connected to the front cover 7 through the connection member 133 and also supported to the side wall of the developing drawer supporting section 124.

When the front cover 7 is in the closed position, each support member 132 is positioned at a first position (FIG. 9) in which the corresponding front and rear guide bosses 135 are respectively positioned at upper rear end portions of the corresponding front and rear support member guide grooves 134.

Further, when the front cover 7 is moved to the open position from the closed position, each support member 132 is pulled diagonally below and frontward by the corresponding connection member 133 and moved diagonally below and frontward while each pair of front and rear guide bosses 135 is guided by the corresponding pair of front and rear support member guide grooves 134.

Further, when the front cover 7 reaches the open position, each support member 132 is positioned at a second position (FIG. 10) in which the corresponding front and rear guide bosses 135 are respectively positioned at lower front end portions of the corresponding front and rear support member guide grooves 134.

When the front cover 7 is moved to the closed position from the open position, each support member 132 is pushed diagonally above and rearward by the corresponding connection member 133 and moved diagonally above and rearward while each pair of front and rear guide bosses 135 is guided by the corresponding pair of front and rear support member guide grooves 134. As a result, each support member 132 is moved to the first position from the second position.

(3) Interlocking Movement of Front Cover and Developing Drawer

Figure 12:
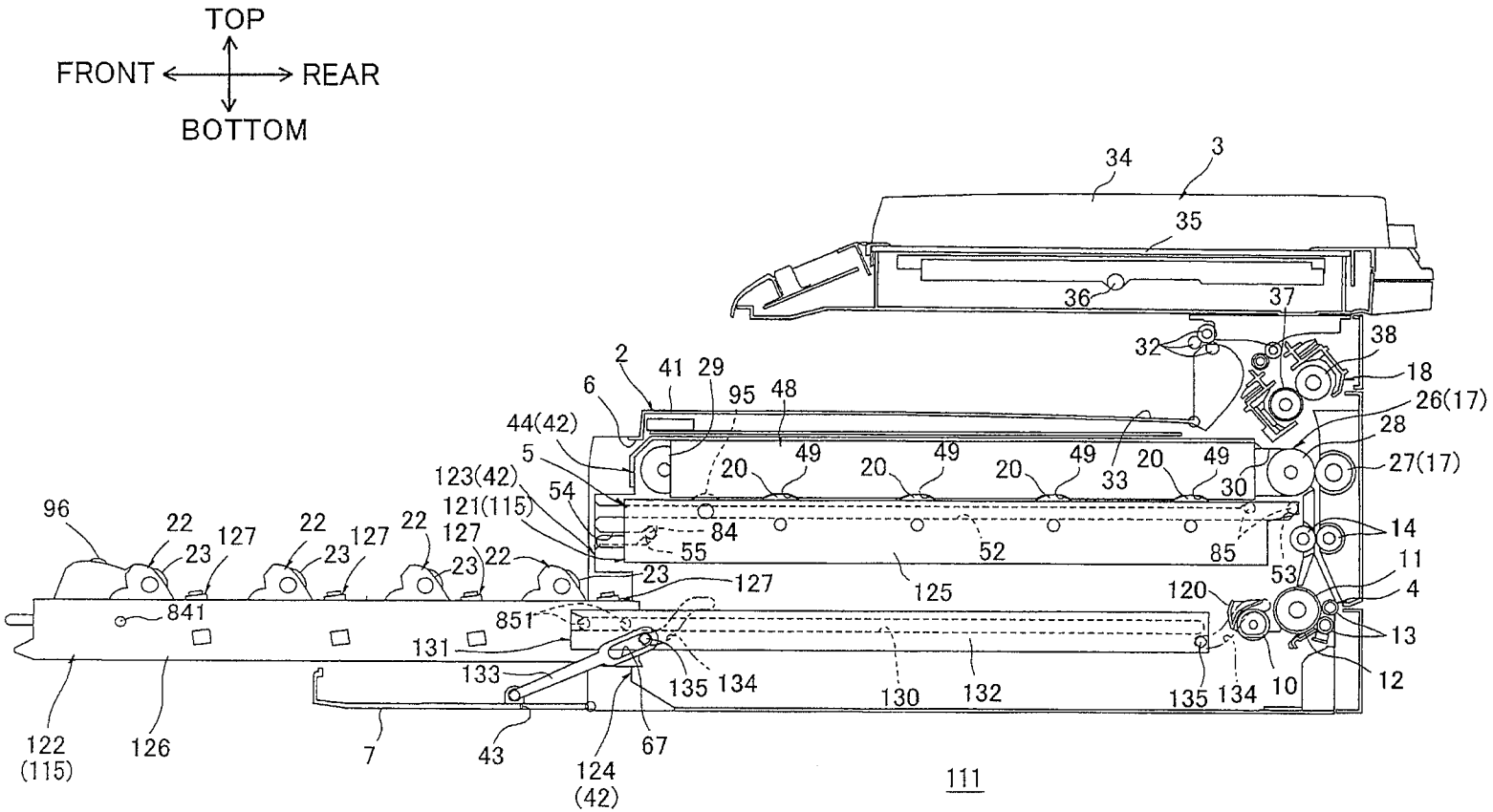
FIG. 12 is an explanatory view illustrating the removal and mounting of the developing drawer relative to the main casing subsequent to FIG. 11, in which the developing drawer has been pulled outward from the main casing.

As shown in FIGS. 11 and 12, the developing drawer 122 is slidingly movably supported to the right and left support members 132, by rotatably inserting the front rollers 841 and the pair of rear rollers 851 into the third guide grooves 130.

As shown in FIGS. 8 and 9, when the front cover 7 is in the closed position and each support member 132 is in the first position, the developing drawer 122 is in the adjacent position.

At this time, each developing roller 23 is positioned diagonally below and frontward of the photosensitive drum 20, and contacts the corresponding photosensitive drum 20. Further, the right and left LED positioning members 105 of each LED unit 127 contact the photosensitive drum 20 from below. Accordingly, the LED array 102 of each LED unit 127 is arranged in confrontation with the corresponding photosensitive drum 20 at a prescribed distance so that the LED array 102 can expose the corresponding photosensitive drum 20.

Figure 10:
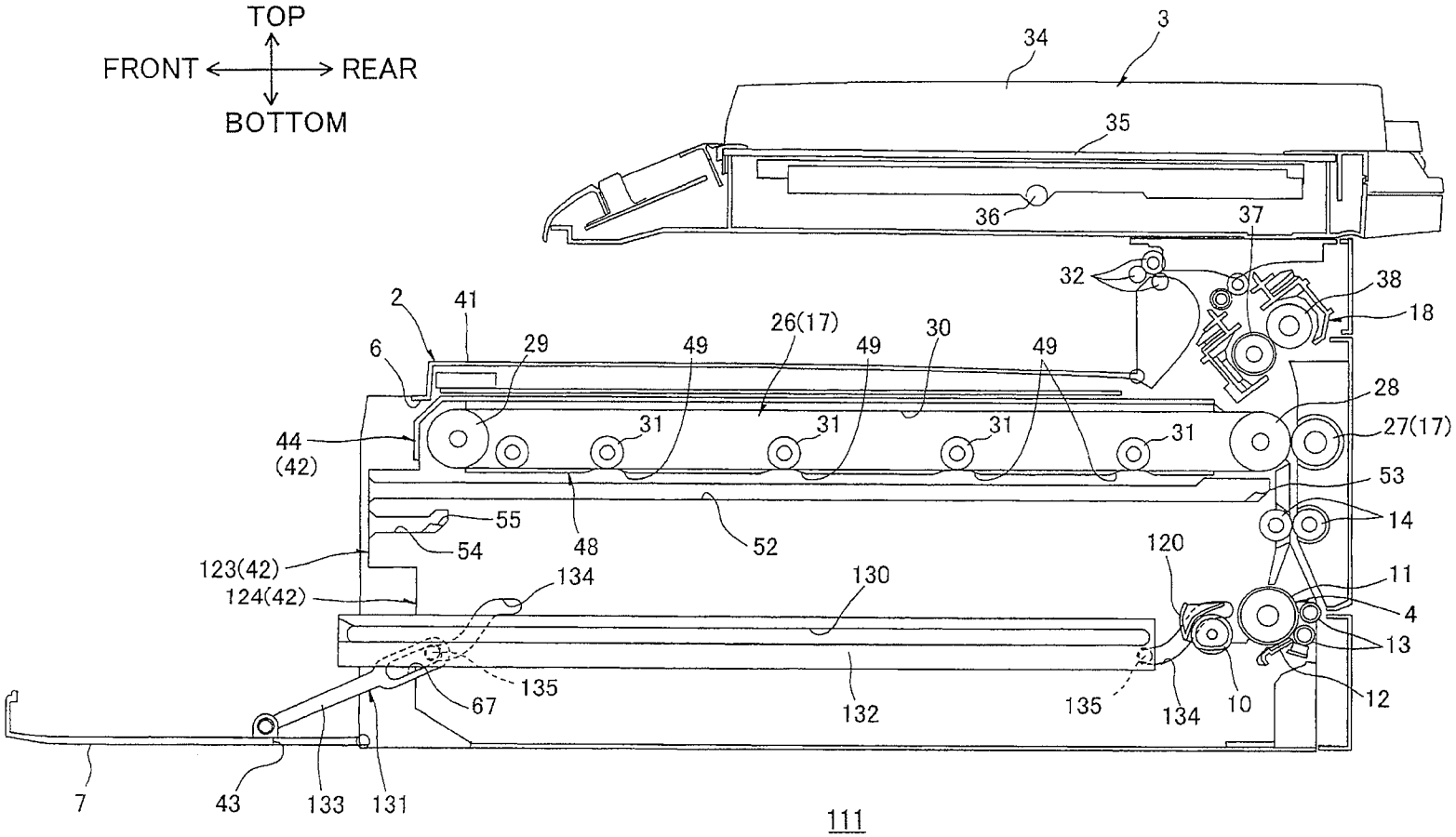
FIG. 10 is an explanatory view illustrating the interlocking movement of the front cover and the support member provided in the color printer shown in FIG. 8, in which the front cover is in an open position and the support member is in a second position.

As shown in FIGS. 10 and 11, when the front cover 7 is moved to the open position from the closed position, each support member 132 is moved to the second position from the first position. Hence, the developing drawer 122 is moved to the retracted position.

At this time, each developing unit 22 and each LED unit 127 are retracted downward from the drum drawer 121 such that the developing unit 22 and the LED units 127 do not interfere with the drum drawer 121 in the rightward/leftward direction when the drum drawer 121 is mounted in or removed from the main casing 2 (FIG. 11).

When the front cover 7 is moved to the closed position from the open position, in conjunction with the movement of each support member 132 to the first position from the second position, the developing drawer 122 is moved to the adjacent position. At this time, a rear wall of the developing drawer 122 is brought into contact with a stopper 120 disposed frontward of the pickup roller 10, thereby positioning the developing drawer 122 with respect to the main casing 2 (FIG. 8).

(4) Removal and Mounting of Drum Drawer and Developing Unit 22

To remove the drum drawer 121 and the developing unit 22 from the main casing 2 or to mount the drum drawer 121 and the developing unit 22 in the main casing 2, initially, the sheet supply tray 8 is pulled frontward to be removed from the main casing 2. Then, the front cover 7 is moved to the open position from the closed position to open the opening 6.

Then, as described above, in response to the movement of the front cover 7 to the open position from the closed position, the developing drawer 122 is moved to the retracted position so as to be retracted into the space formed by removing the sheet supply tray 8 from the main casing 2.

Figure 13:
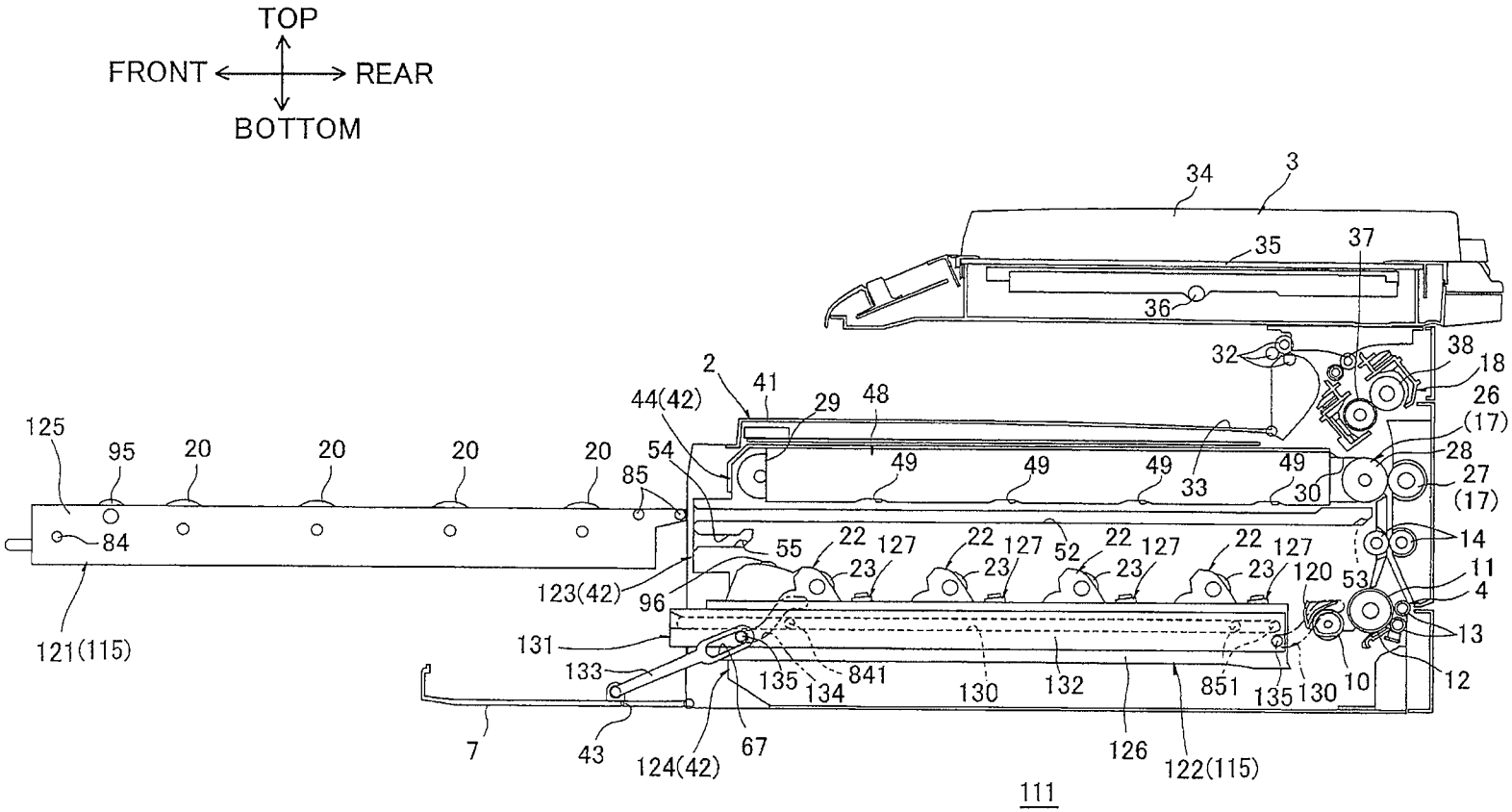
FIG. 13 is an explanatory view illustrating the removal and mounting of the drum drawer relative to the main casing subsequent to FIG. 11, in which the drum drawer has been pulled outward from the main casing.

Then, to remove the drum drawer 121 from the main casing 2, as shown in FIG. 13, the drum drawer 121 is pulled frontward from the main casing 2 through the opening 6.

Then, each rearmost roller 85 of the drum drawer 121 is separated from the corresponding leaf spring 53 at the rear portion of the corresponding first guide groove 52. Each front roller 84 of the drum drawer 121 is also separated from the corresponding leaf spring 55 at the rear portion of the corresponding second guide groove 54. As a result, the drum drawer 121 is moved downward so that each photosensitive drum 20 is separated from the lower portion of the intermediate transfer belt 30.

Subsequently, when drum drawer 121 is further pulled frontward, the drum drawer 121 is guided by the first guide grooves 52 and the second guide grooves 54, and pulled outward from the main casing 2 while maintaining a slight gap between the lower portion of the intermediate transfer belt 30 and the drum drawer 121. Hence, the drum drawer 121 is removed from the main casing 2. At this time, since the developing drawer 122 is in the retracted position, the developing drawer 122 does not interfere with the movement of the drum drawer 121 in the rightward/leftward direction.

To remove the developing unit 22 from the main casing 2 or to mount the developing unit 22 in the main casing 2, as shown in FIG. 12, the developing drawer 122 is pulled frontward from the main casing 2 through the opening 6.

Then, the developing unit 22 is removed from or mounted in the developing drawer 122 pulled outward from the main casing 2. More specifically, to remove the developing unit 22 from the developing drawer 122, the developing unit 22 is pulled upward. To mount the developing unit 22 in the developing drawer 122, the developing unit 22 is positioned at a prescribed position to be inserted into the developing drawer frame 126 of the developing drawer 122 from above.

By performing, in reverse order, the above-described operation for removing the drum drawer 121 and the developing drawer 122 from the main casing 2, the drum drawer 121 and the developing drawer 122 are mounted in the main casing 2.

More specifically, to mount the drum drawer 121 in the main casing 2, the drum drawer 121 is inserted into the main casing 2 along the first guide grooves 52 and the second guide grooves 54.

At this time, the drum drawer 121 is guided by the first guide grooves 52 and the second guide grooves 54 to be inserted into the main casing 2 while maintaining a slight gap between the lower portion of the intermediate transfer belt 30 and the drum drawer 121.

Then, each rearmost roller 85 of the drum drawer 121 rides up over the corresponding leaf spring 53 at the rear portion of the corresponding first guide groove 52. Each front roller 84 of the drum drawer 121 also rides up over the corresponding leaf spring 55 at the rear portion of the corresponding second guide groove 54. The drum drawer 121 is thus moved upward so that each photosensitive drum 20 is brought into contact with the lower portion of the intermediate transfer belt 30.

As a result, the drum drawer 121 is mounted in the main casing 2 so as to be constantly biased upward by the biasing forces of the leaf springs 53 and the leaf springs 55.

Further, to mount the developing drawer 122 in the main casing 2, the developing drawer 122 is initially inserted into the main casing 2 along the third guide grooves 130 of the support members 132. Then, the front cover 7 is moved to the closed position from the open position, so that the developing drawer 122 is moved to the adjacent position as described above.

Then, after the front cover 7 is moved to the closed position, the sheet supply tray 8 is mounted in the main casing 2 through the opening 43 of the front cover 7.

(5) Operations and Effects of Second Embodiment

In the color printer 111 according to the second embodiment, operations and effects similar to those of the first embodiment can also be obtained.

As shown in FIG. 8, the color printer 111 according to the second embodiment includes the developing drawer 122. The developing drawer 122 retains the four developing units 22 and the four LED units 127 therein. The developing drawer 122 is movable between the adjacent position located adjacent to the four photosensitive drums 20 and the retracted position retracted from the four photosensitive drums 20.

Hence, the developing unit 22 whose replacement frequency is higher can be replaced with a new one separately from replacement of the photosensitive drum 20. Therefore, replacement of each developing unit 22 can be efficiently conducted.

Further, as shown in FIG. 8, the color printer 111 according to the second embodiment includes the belt cleaning unit 93 for cleaning the intermediate transfer belt 30. The belt cleaning unit 93 is arranged in confrontation with the intermediate transfer belt 30 in a direction the same as a direction that each photosensitive drum 20 confronts the intermediate transfer belt 30. That is, the belt cleaning unit 93 is arranged in confrontation with the intermediate transfer belt 30 from below.

Compared with a case where the belt cleaning unit 93 is arranged in confrontation with the intermediate transfer belt 30 in a direction opposite to the direction that each photosensitive drum 20 confronts the intermediate transfer belt 30 (i.e. the belt cleaning unit 93 is arranged in confrontation with the intermediate transfer belt 30 from above), the color printer 111 can be downsized in the vertical direction (i.e. the direction that each photosensitive drum 20 confronts the intermediate transfer belt 30).

Further, in the color printer 111 according to the second embodiment, the waste toner retaining section 94 for accommodating the waste toner is provided in the developing drawer 122.

Hence, replacement of the waste toner retaining section 94 can be efficiently conducted together with the developing drawer 122 whose replacement frequency is higher.

While the present invention has been described in detail with reference to the present embodiments thereof, it would be apparent to those skilled in the art that various changes and modifications may be made therein without departing from the spirit of the present invention.

What is claimed is:

1. An image forming device comprising:

a main casing;

a first retaining member that retains a plurality of photosensitive drums juxtaposedly arrayed and spaced away from each other in a prescribed direction, the first retaining member configured to move in the prescribed direction between a mounted position in which the first retaining member is mounted in the main casing and a pulled-out position in which the first retaining unit is pulled out of the main casing;

a second retaining member that retains a plurality of developing units each opposing a corresponding photosensitive drum and is configured to move between a second adjacent position, in which the plurality of developing units is located adjacent to the plurality of photosensitive drums, and a second retracted position, in which the plurality of developing units is moved away from the plurality of photosensitive drums;

an endless belt disposed above the first retaining member to oppose the plurality of photosensitive drums;

a plurality of exposure units disposed below the endless belt and configured to move between a first adjacent position, in which each of the plurality of exposure units is located adjacent to the corresponding photosensitive drum to expose thereof, and a first retracted position, in which each of the plurality of exposure units is moved away from the corresponding photosensitive drum in a direction intersecting with the prescribed direction, wherein the plurality of exposure units is provided on the second retaining member; and a tray disposed in confrontation with the first retaining member from below and configured to be inserted into or removed from the main casing, a space being formed by removing the tray from the main casing, wherein the space is occupied by the tray when the tray is inserted in the main casing, the tray configured to hold a medium, wherein each of the plurality of exposure units is configured to move to the first retracted position by moving to the space formed by removing the tray from the main casing, and wherein, when the plurality of exposure units is in the first retracted position, the plurality of exposure units do not interfere with the first retaining member in the prescribed direction when the first retaining member moves from the mounted position to the pulled-out position.

2. The image forming device according to claim 1, wherein the main casing has an opening through which the first retaining member is moved between the mounted position and the pulled-out position, wherein the main casing comprises:

a cover configured to move between an open position opening the opening and a closed position closing the opening; and an interlocking mechanism that moves each of the plurality of exposure units from the first adjacent position to the first retracted position in conjunction with a movement of the cover from the closed position to the open position, and moves each of the plurality of exposure units from the first retracted position to the first adjacent position in conjunction with a movement of the cover from the open position to the closed position.

3. The image forming device according to claim 2, wherein the tray restricts a movement of the cover to the open position by interfering with the cover when the tray is inserted into the main casing.

4. The image forming device according to claim 1, further comprising a cleaning unit arranged in confrontation with the endless belt in a direction equivalent to a direction in which each of the plurality of photosensitive drums confronts the endless belt and configured to clean the endless belt.

5. The image forming device according to claim 4, wherein the cleaning unit comprises a waste developer retaining portion for accommodating a waste developer, the waste developer retaining portion being provided on the second retaining member.

6. The image forming device according to claim 1, further comprising a supplying member that is configured to supply the medium accommodated in the tray, the supplying member being arranged to overlap with the first retaining member in the prescribed direction when the first retaining member is in the mounted position.

7. The image forming device according to claim 1, wherein the main casing has an opening through which the first retaining member is moved between the mounted position and the pulled-out position, wherein the main casing comprises:

a cover configured to move between an open position opening the opening and a closed position closing the opening; and an interlocking mechanism that moves the second retaining member from the second adjacent position to the second retracted position in conjunction with a movement of the cover from the closed position to the open position, and moves second retaining member from the second retracted position to the second adjacent position in conjunction with a movement of the cover from the open position to the closed position.

8. The image forming device according to claim 1, further comprising a supplying member that is configured to supply the medium accommodated in the tray, the supplying member being arranged to overlap with the second retaining member in the prescribed direction when the second retaining member is in the adjacent position.

9. An image forming device comprising:

a main casing having a first accommodation portion and a second accommodation portion therein;

a first retaining member retaining a plurality of photosensitive drums juxtaposedly arrayed and spaced away from each other in a prescribed direction, the first retaining member being configured to move in the prescribed direction between a mounted position, in which the first retaining member is mounted and disposed in the first accommodation portion in the main casing, and a pulled-out position, in which the first retaining unit is pulled out of the main casing;

an endless belt disposed above the first retaining member to oppose the plurality of photosensitive drums;

a tray disposed in the second accommodation portion in a lower part of the main casing where the tray is in confrontation with the first retaining member, the tray being removable from the main casing and configured to hold a sheet-like medium; and a plurality of exposure units disposed below the endless belt and configured to move between a first adjacent position in which each of the plurality of exposure units is located adjacent to a corresponding photosensitive drum to expose thereof and a first retracted position in which each of the plurality of exposure units is moved away from the corresponding photosensitive drum in a direction intersecting with the prescribed direction, wherein a part of each of the plurality of exposure units is disposed in the first accommodation portion of the first retaining member when the plurality of exposure units is in the first adjacent position, and the part of each of the plurality of exposure units is disposed in the second accommodation portion when the plurality of exposure units is in the first retracted position.

10. The image forming device according to claim 9, wherein the main casing has an opening through which the first retaining member is moved between the mounted position and the pulled-out position, wherein the main casing comprises:

a cover configured to move between an open position opening the opening and a closed position closing the opening; and an interlocking mechanism that moves each of the plurality of exposure units from the first adjacent position to the first retracted position in conjunction with a movement of the cover from the closed position to the open position, and moves each of the plurality of exposure units from the first retracted position to the first adjacent position in conjunction with a movement of the cover from the open position to the closed position.

11. The image forming device according to claim 10, wherein the tray restricts a movement of the cover to the open position by interfering with the cover when the tray is inserted into the main casing.

12. The image forming device according to claim 9, further comprising a second retaining member that retains a plurality of developing units each opposing the corresponding photosensitive drum and is configured to move between a second adjacent position in which the plurality of developing units is located adjacent to the plurality of photosensitive drums and a second retracted position in which the plurality of developing units is moved away from the plurality of photosensitive drums, wherein the plurality of exposure units is provided on the second retaining member.

13. The image forming device according to claim 12, further comprising a cleaning unit arranged in confrontation with the endless belt in a direction equivalent to a direction in which each of the plurality of photosensitive drums confronts the endless belt and configured to clean the endless belt.

14. The image forming device according to claim 12, wherein the main casing has an opening through which the first retaining member is moved between the mounted position and the pulled-out position, wherein the main casing comprises:

a cover configured to move between an open position opening the opening and a closed position closing the opening; and an interlocking mechanism that moves the second retaining member from the second adjacent position to the second retracted position in conjunction with a movement of the cover from the closed position to the open position, and moves second retaining member from the second retracted position to the second adjacent position in conjunction with a movement of the cover from the open position to the closed position.

15. The image forming device according to claim 12, further comprising a supplying member that is configured to supply the medium accommodated in the tray, the supplying member being arranged to overlap with the second retaining member in the prescribed direction when the second retaining member is in the adjacent position.

16. The image forming device according to claim 13, wherein the cleaning unit comprises a waste developer retaining portion for accommodating a waste developer, the waste developer retaining portion being provided on the second retaining member.

17. The image forming device according to claim 9, further comprising a supplying member that is configured to supply the medium accommodated in the tray, the supplying member being arranged to overlap with the first retaining member in the prescribed direction when the first retaining member is in the mounted position.

* * * * *